US007984980B2

(12) United States Patent
Kachi

(10) Patent No.: US 7,984,980 B2
(45) Date of Patent: Jul. 26, 2011

(54) INK CARTRIDGE AND INKJET RECORDING APPARATUS

(75) Inventor: Yasuhiko Kachi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 951 days.

(21) Appl. No.: 11/905,266

(22) Filed: Sep. 28, 2007

(65) Prior Publication Data

US 2008/0079790 A1 Apr. 3, 2008

(30) Foreign Application Priority Data

Sep. 29, 2006 (JP) ..... 2006-269585

(51) Int. Cl.
*B41J 2/175* (2006.01)
*B41J 2/195* (2006.01)

(52) U.S. Cl. ..... 347/86; 347/7

(58) Field of Classification Search ..... 347/7, 19, 347/85, 86, 87
See application file for complete search history.

(56) References Cited

U.S. PATENT DOCUMENTS

| | | | | |
|---|---|---|---|---|
| 4,719,475 | A * | 1/1988 | Kiyohara et al. | 347/86 |
| 5,574,490 | A | 11/1996 | Gragg et al. | |
| 5,611,461 | A * | 3/1997 | Kubota et al. | 222/105 |
| 5,691,755 | A * | 11/1997 | Pawlowski et al. | 347/86 |
| 6,227,662 | B1 * | 5/2001 | Takata | 347/86 |
| 6,585,359 | B1 * | 7/2003 | Gasvoda et al. | 347/86 |
| 6,969,161 | B2 * | 11/2005 | Kuwabara et al. | 347/85 |
| 7,334,888 | B2 * | 2/2008 | Sasaki et al. | 347/86 |
| 7,677,712 | B2 * | 3/2010 | Ishizawa et al. | 347/86 |
| 2002/0122084 | A1 * | 9/2002 | Shihoh et al. | 347/7 |

FOREIGN PATENT DOCUMENTS

| | | | |
|---|---|---|---|
| JP | 6-155759 | A | 6/1994 |
| JP | 11-115206 | A | 4/1999 |
| JP | 11-123834 | A | 5/1999 |
| JP | 11-342623 | A | 12/1999 |
| JP | 2000-280493 | A | 10/2000 |
| JP | 2002-248795 | A | 9/2002 |
| JP | 2003-266734 | A | 9/2003 |
| JP | 2006-15695 | A | 1/2006 |

OTHER PUBLICATIONS

Japanese Office Action issued in JP Application No. 2006-269585 on May 10, 2011.

* cited by examiner

*Primary Examiner* — Anh T. N. Vo
(74) *Attorney, Agent, or Firm* — Birch, Stewart, Kolasch & Birch, LLP

(57) ABSTRACT

The ink cartridge has: a cartridge container having a flat box shape; an ink bag that is made of a plastic material or an elastic body, accommodates ink, is disposed in the cartridge container, and has an ink supply port via which the ink is extracted from the ink bag, wherein: the cartridge container has an air connection port by which an interior of the cartridge container in which the ink bag disposed is able to connect to an atmospheric air; the ink bag has a flat shape matching the flat box shape of the cartridge container; the ink bag is provided with a negative pressure generating device which applies impelling force to the ink bag in a direction of expanding a volume of the ink bag to generate a negative pressure inside the ink bag; and the impelling force applied to generate the negative pressure inside the ink bag by the negative pressure generating device, becomes less in a continuous or a stepwise fashion, as a distance from the ink supply port of the ink bag increases.

10 Claims, 22 Drawing Sheets

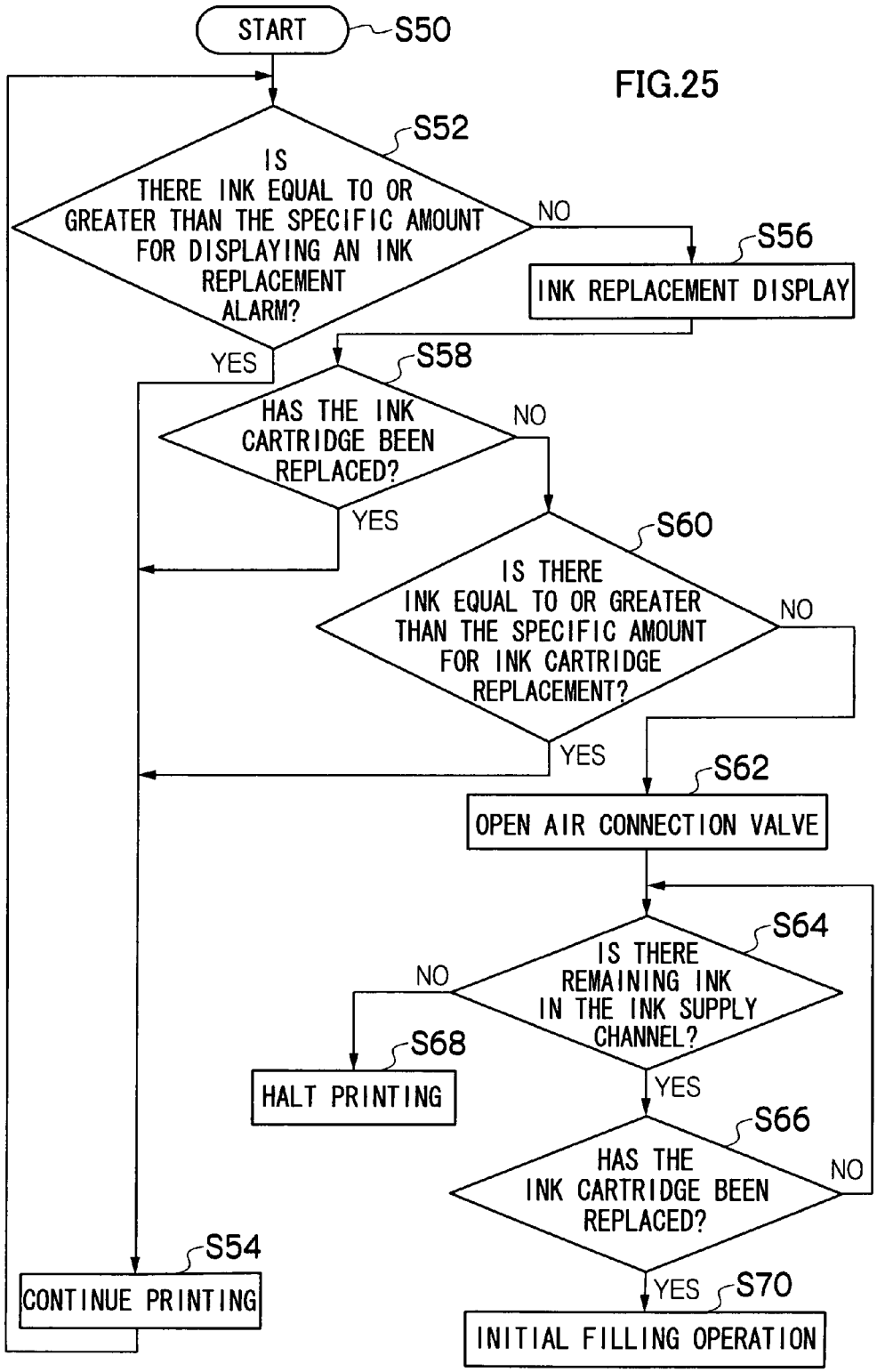
START
S50
FIG.25
S52
IS THERE INK EQUAL TO OR GREATER THAN THE SPECIFIC AMOUNT FOR DISPLAYING AN INK REPLACEMENT ALARM?
NO
S56
INK REPLACEMENT DISPLAY
YES
S58
HAS THE INK CARTRIDGE BEEN REPLACED?
NO
YES
S60
IS THERE INK EQUAL TO OR GREATER THAN THE SPECIFIC AMOUNT FOR INK CARTRIDGE REPLACEMENT?
NO
YES
S62
OPEN AIR CONNECTION VALVE
S64
IS THERE REMAINING INK IN THE INK SUPPLY CHANNEL?
NO
S68
HALT PRINTING
YES
S66
HAS THE INK CARTRIDGE BEEN REPLACED?
NO
YES
S70
INITIAL FILLING OPERATION
S54
CONTINUE PRINTING

INK CARTRIDGE AND INKJET RECORDING APPARATUS

BACKGROUND OF THE INVENTION

1. Field of the Invention

The present invention relates to the structure of an ink cartridge used in an inkjet recording apparatus and to an inkjet recording apparatus using this ink cartridge.

2. Description of the Related Art

In recent years, inkjet recording apparatuses (inkjet printers) have become widely used as apparatuses which print and record images that have been captured by a digital camera, and the like. Many domestic inkjet recording apparatuses use a serial scanning system which ejects ink while scanning (moving) a print head mounted on a carriage back and forth reciprocally in the main scanning direction, which is perpendicular to the paper conveyance direction. In such domestic inkjet recording apparatuses, vertically disposed ink cartridges (ink tanks) are arranged in the upper portion of the print head.

An ink absorbing body, such as a polymer foam body, is disposed inside a conventional ink cartridge of this kind, and a negative pressure is generated by means of the capillary force of the ink absorbing body. Japanese Patent Application Publication No. 6-155759 discloses a structure in which a pressure adjuster for generating negative pressure using a spring is disposed inside a cartridge, in view of the environmental problems which arises with the disposal of polymer foam bodies inside used cartridges. However, Japanese Patent Application Publication No. 6-155759 does not disclose a method for determining the remaining amount of ink. In view of this point, Japanese Patent Application Publication No. 2002-248795 discloses a composition in which the remaining amount of ink is determined by means of a sensor which determines the position of a lever which abuts against an ink bag having an external diameter dimension that varies in accordance with the ink volume.

As described above, in the structure commonly employed in domestic inkjet recording apparatuses, in other words, in a system in which an ink cartridge is mounted on a head on a carriage, since a cartridge having a large volume is carried on the upper portion of the head and is moved back and forth reciprocally (in a main scanning action) together with the head, it is necessary to provide a large space inside the apparatus to allow for the travel of the head, and hence there is a problem in that space is not used efficiently.

Furthermore, since the conventional ink cartridge described above accommodates a member such as a polymer foamed body, as well as ink, inside the cartridge, then there is a problem in that the ink accommodation efficiency is poor.

On the other hand, in wide format printers, such as commercial printers, an ink bag system which has good ink accommodation efficiency is known, but since a negative pressure is applied in accordance with the lifting height, then there are restrictions on the position in which the ink bag can be disposed if it is sought to set the internal pressure of the head to a specific pressure.

Furthermore, when using an ink bag system, it is difficult to ascertain accurately the amount of change in the volume of the bag, and therefore in the conventional remaining amount of ink determination method disclosed in Japanese Patent Application Publication No. 2002-248795, it is difficult to ascertain the remaining amount of ink accurately. In particular, when using an ink bag system in an ink cartridge having a relatively small volume, such as a domestic inkjet recording apparatus, it is even more difficult to determine the volume change accurately. Consequently, it is not possible to use up the ink inside the ink bag accurately, right up to the last, and hence there is a possibility that the amount of wasted ink is large.

SUMMARY OF THE INVENTION

The present invention has been contrived in view of these circumstances, an object thereof being to provide an ink cartridge which contributes to improving the spatial efficiency of an inkjet recording apparatus, to provide an ink cartridge which enables the ink accommodated therein to be used without waste, to provide an ink cartridge which enables the remaining amount of ink to be determined accurately, to provide an ink cartridge which enables increased freedom in the positioning of the ink cartridge in the apparatus, and to provide an inkjet recording apparatus which uses an ink cartridge of this kind.

In order to attain the aforementioned object, the present invention is directed to an ink cartridge comprising: a cartridge container having a flat box shape; an ink bag that is made of a plastic material or an elastic body, accommodates ink, is disposed in the cartridge container, and has an ink supply port via which the ink is extracted from the ink bag, wherein: the cartridge container has an air connection port by which an interior of the cartridge container in which the ink bag disposed is able to connect to an atmospheric air; the ink bag has a flat shape matching the flat box shape of the cartridge container; the ink bag is provided with a negative pressure generating device which applies impelling force to the ink bag in a direction of expanding a volume of the ink bag to generate a negative pressure inside the ink bag; and the impelling force applied to generate the negative pressure inside the ink bag by the negative pressure generating device, becomes less in a continuous or a stepwise fashion, as a distance from the ink supply port of the ink bag increases.

According to this aspect of the present invention, by adopting such a flat-shaped ink cartridge having a negative pressure generating device, the freedom of positioning of the ink cartridge in the inkjet recording apparatus is raised, the height of the apparatus can be reduced.

Moreover, since the ink cartridge according to this aspect of the present invention deforms (contracts) from the portion which is distant from the ink supply port (the ink extraction port), as the ink is consumed, then it is possible to use up the ink efficiently without the ink supply port becoming sealed, and therefore the amount of wasted ink is reduced.

Preferably, the negative pressure generating device includes a collapsible fold formed in a perimeter of the ink bag; and the collapsible fold in a portion of the ink bag which is relatively farther from the ink supply port is larger in size than the collapsible fold in a portion of the ink bag which is relatively nearer to the ink supply port.

According to this aspect of the invention, it is possible to generate a negative pressure by using the elasticity of the fold. In addition, the portion having the larger fold which is further from the ink supply port is more liable to deform firstly as the ink inside the ink bag is consumed, and therefore it is possible to use up the ink efficiently without the ink supply port becoming sealed.

Preferably, the negative pressure generating device includes a spring member that is provided on an outer circumferential face of the ink bag, near the ink supply port.

By using such a spring member instead of or in combination with the elasticity of the collapsible fold, it is possible to generate a negative pressure and create a greater impelling force in the region that is near the ink supply port.

Preferably, the negative pressure generating device comprises a first spring member and a second spring member which are provided on an outer circumferential face of the ink bag at a plurality of positions at different distances from the ink supply port, the first spring member being relatively nearer to the ink supply port and the second spring member being relatively farther from the ink supply port; and the impelling force of the first spring is greater than the impelling force of the second spring member.

By using such a plurality of spring members having different impelling forces (spring constants), it is possible to achieve a composition in which the impelling force in a portion nearer the ink supply port is larger while the impelling force in a portion farther from the ink supply port is smaller.

Preferably, the ink bag is constituted by an elastic body, elastic force in a portion of the elastic body which is relatively nearer the ink supply port being greater than elastic force in a portion of the elastic body which is relatively farther from the ink supply port.

By constituting the ink bag itself by an elastic body and varying the elastic force of the elastic body in accordance with the position in the ink bag, it is possible to achieve a composition in which the ink bag contracts initially from the portion that is farther from the ink supply port (a composition where the vicinity of the ink supply port is not sealed off until the very last).

Preferably, the ink bag is constituted by the elastic body of which a thickness of the portion which is relatively nearer the ink supply port is greater than a thickness of the portion which is relatively farther from the ink supply port.

By varying the thickness (thick-wall) of the elastic body, it is possible to alter the elastic force and therefore a composition can be achieved in which the ink bag contracts initially from the portion that is further from the ink supply port (a composition where the vicinity of the ink supply port is not sealed off until the very last).

Preferably, the ink bag has light transmitting regions through which light can pass in a thickness direction of the ink bag, and which are provided in a plurality of positions at different distances from the ink supply port, and the cartridge container has a plurality of light passing sections which enable the light to pass through the light transmitting regions.

In a desirable mode, a non-contact optical sensor is used as the device which determines the remaining amount of ink in the ink cartridge, and desirably, the ink bag and the cartridge container have a composition which allows light to pass, in order to allow the use of an optical sensor of this kind. In particular, in the case of the ink cartridge according to this aspect of the present invention, since the mode of deformation of the ink bag differs between the portion near to the ink supply port and the portion distant from the ink supply port, then it is desirable to determine the remaining amount of ink by means of optical sensors at a plurality of positions located at different distances from the ink supply ports.

Preferably, the light passing sections form apertures of the air connection ports.

It is possible to use the air connection ports as the light passing sections.

Preferably, the ink cartridge further comprises an integrated circuit memory chip which stores at least one information element with respect to the ink bag from among an internal negative pressure at completion of ink filling, an ink filling capacity, number of filling operations, and filling date and time.

Since the ink cartridge according to this aspect of the present invention can be used repeatedly by refilling with ink, it is desirable that the required attribute information should be written to the IC memory chip each time the cartridge is refilled.

In order to attain the aforementioned object, the present invention is also directed to an inkjet recording apparatus comprising: one of the ink cartridges described above; a print head that has nozzles from which ink is ejected; a sub tank which is disposed above the print head, stores the ink supplied from the ink cartridge, and connects to the print head to supply the ink to the print head; and a scanning device which moves the print head in a direction perpendicular to a direction of conveyance of a recording medium, wherein a nozzle liquid surface pressure of the print head is set to be in a range of −20 mm $H_2O$ to −70 mm $H_2O$ when the ink cartridge and the sub tank are in a connected state.

In general, in order to maintain a meniscus at the nozzle surface, it is necessary for an inkjet head (print head) to keep the interior of the head at a suitable negative pressure. The ink cartridge according to this aspect of the present invention has a structure which enables the interior of the ink cartridge itself to be maintained at a negative pressure. Therefore, by setting the negative pressure imparting force of the negative pressure generating device of the ink cartridge to a suitable value according to the compositional features of the apparatus, such as the height of the nozzle surface in the print head, the positions and structure of the sub tank, the arrangement position (height) of the ink cartridge, and the like, it is possible to adopt a variety of different layouts, in which the pressure is not limited to that created by the hydraulic height (lifting height) due to the positioning of the ink cartridge. In other words, it is possible to adopt a mode in which the ink cartridge is disposed above the nozzle surface of the head, or to adopt a mode in which the ink cartridge is disposed below the nozzle surface of the head.

Moreover, the "recording medium" indicates a medium (media) which receives ink ejected by means of a print head, and this term includes various types of media, irrespective of material and size, such as continuous paper, cut paper, sealed paper, resin sheets such as OHP sheets, film, cloth, and other materials.

In order to attain the aforementioned object, the present invention is also directed to an inkjet recording apparatus comprising: one of the ink cartridges described above; a print head that has nozzles from which ink is ejected; a sub tank which is disposed above the print head, stores the ink supplied from the ink cartridge, and connects to the print head to supply the ink to the print head; a scanning device which moves the print head in a direction perpendicular to a direction of conveyance of a recording medium; a remaining ink amount in cartridge determination device which determines a remaining amount of the ink in the ink bag of the ink cartridge; an ink supply channel via which the ink is supplied to the print head from the ink cartridge; an air releasing valve provided in a vicinity of the ink supply port of the ink bag, on a downstream side of the ink supply port; a remaining ink amount in supply channel determination device which determines a remaining amount of the ink in the ink supply channel; and a control device which implements control in such a manner that, when the remaining amount of the ink in the ink bag determined by the remaining ink amount in cartridge determination device is less than a prescribed value, the air releasing valve is opened to continue printing.

According to this aspect of the invention, even if the remaining amount of ink in the ink cartridge has reached a specified value at which replacement of the cartridge is required, it is possible to continue ink ejection from the print head by using the ink in the ink supply channel and the sub tank, on the downstream side of the air releasing valve.

Preferably, a surface of one portion of the sub tank is constituted by an elastic deformation member formed by a combination of a plastic film and a leaf spring; and the elastic deformation member is displaced in such a manner that an interior of the sub tank is maintained at a negative pressure.

According to this aspect of the invention, it is possible to maintain the internal pressure of the head at a negative pressure by means of the negative pressure maintaining mechanism of the sub tank, and hence there is no need to maintain the negative pressure by means of a pump, or the like, and the structure of the apparatus can therefore be made more compact.

Preferably, an ink supply coupling section of the ink supply channel is provided in at least one end section of a region in which the print head is moved by means of the scanning device, and connects to the ink supply port of the ink cartridge; a coupling section which is couplable to and decouplable from the ink supply coupling section is provided on a side of the sub tank above the print head; and when the ink is supplied to the sub tank, the coupling section is coupled to the ink supply coupling section, whereas when printing is carried out by means of the print head, the coupling section is decoupled from the ink supply coupling section.

In this aspect of the invention, an inkjet recording apparatus based on a so-called "pit stop" ink supply system is provided, in which the print head is separated from the ink supply coupling section of the ink supply system during execution of a printing operation, ink ejection being performed by means of the ink in the sub tank, and when supplying ink, the sub tank of the print head is coupled to the ink supply coupling section and ink is replenished into the sub tank.

According to the present invention, the freedom of positioning of the ink cartridge within the inkjet recording apparatus is raised, and beneficial effects in reducing the height of the apparatus are obtained.

Furthermore, according to the ink cartridge of the present invention, it is possible to use up the ink accommodated in the ink bag, to the very last, without waste, since the ink supply port (ink extraction port) is not sealed off.

Moreover, according to the inkjet recording apparatus relating to one mode of the present invention, even in a case where the ink in the ink cartridge has run out, it is still possible to continue printing by using the ink remaining in the ink supply channel and the sub tank.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 25 is a flowchart of an end sequence relating to the remaining ink.

DETAILED DESCRIPTION OF THE PREFERRED EMBODIMENTS

Composition of Ink Cartridge

Figure 1:
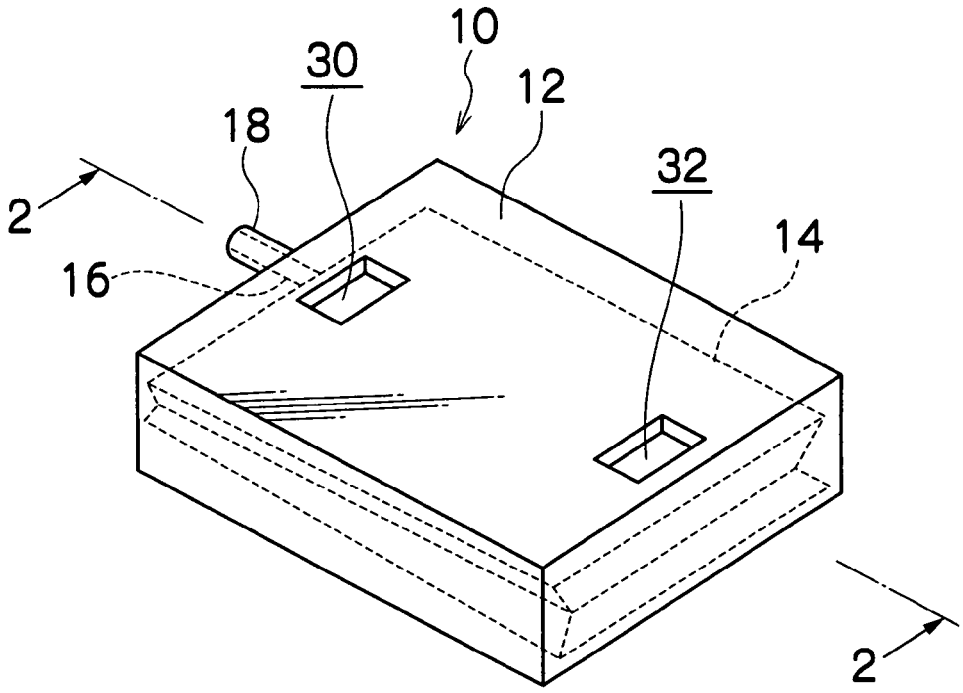
FIG. 1 is a perspective diagram of an ink cartridge relating to an embodiment of the present embodiment.
Figure 2:
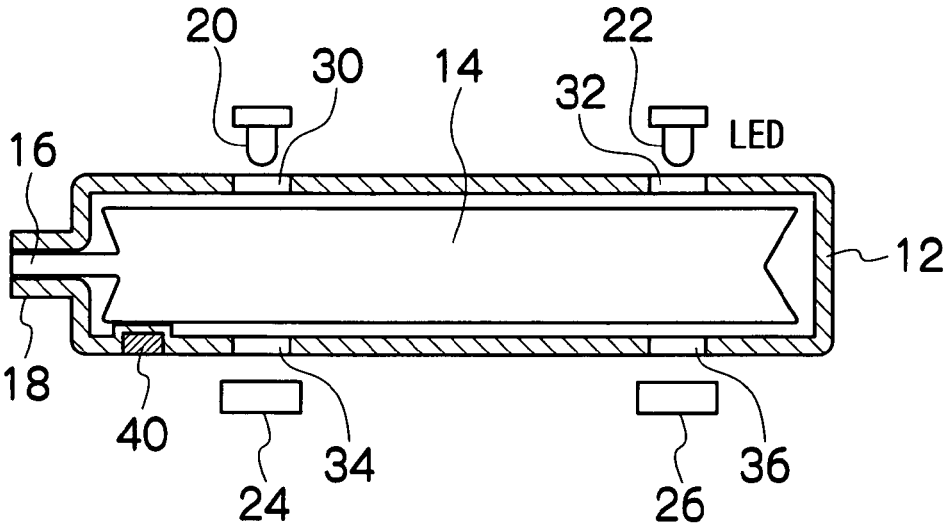
FIG. 2 is a cross-sectional diagram along line 2-2 in FIG. 1.

FIG. 1 is a perspective diagram of an ink cartridge relating to an embodiment of the present invention; and FIG. 2 is a cross-sectional diagram of same. As shown in these diagrams, the ink cartridge 10 according to the present embodiment has structure in which a flat ink bag 14 which contains ink liquid is accommodated inside a cartridge container 12 which overall has a flat substantially rectangular shape. The cartridge container 12 is a hard case body which is formed from a relatively hard material, such as plastic, and it has sufficient rigidity to enable it to maintain a prescribed external shape (in the present embodiment, a substantially rectangular shape as shown in FIG. 1 and FIG. 2).

The ink bag 14 is made of a plastic material of which the external shape is able to deform in accordance with the amount of ink liquid contained therein, and the shape and interior volume of the ink bag 14 vary in accordance with the amount of ink liquid. An ink supply port 16 which forms a flow channel for extracting ink liquid and refilling ink liquid is provided on one end face of the ink bag 14. A tubular coupling section 18 into which the ink supply port 16 is inserted and fixed is provided in a projecting manner at a position of the cartridge container 12 corresponding to the ink supply port 16, in order to hold the tube-shaped ink supply port 16.

For example, as shown in FIG. 2, the ink cartridge 10 having the composition described above is installed in an inkjet recording apparatus in a state where the flat shape is kept in a substantially horizontal fashion with the thickness direction lying in the direction of gravitational force (in the vertical direction) (in an attitude where the flat shape is substantially perpendicular to the direction of gravitational force). Assuming this installation attitude is adopted, light-emitting elements 20 and 22 and photoreceptor elements 24 and 26 forming devices which determine the remaining amount of ink (which correspond to a "remaining amount of ink in cartridge determination device") are disposed in mutually opposing upper and lower positions on either side of the ink cartridge 10.

Openings 30, 32, 34 and 36 (which correspond to "light transmitting sections" and "air connection ports") that allow transmission of light between the light transmitting elements 20 and 22 and the photoreceptor elements 24 and 26, are formed on the upper face and the lower face of the cartridge container 12, in positions corresponding to the light-emitting elements 20 and 22 and the photoreceptor elements 24 and 26.

The full circumferential surface of the ink bag 14, or at least the portion of the circumferential surface of the ink bag 14 in the positions corresponding to the openings 30, 32, 34 and 36 of the cartridge container 12 is formed in such a manner that the light emitted from the light-emitting elements 20 and 22 is transmitted through the ink bag 14 and arrives at the photoreceptor elements 24 and 26.

The openings 30, 32, 34 and 36 formed in the cartridge container 12 not only create transmission paths for the light, but also function as air connection ports which connect the interior of the cartridge container 12 to the atmosphere to apply the atmospheric pressure to the outer sides of the ink bag 14. There is also a mode in which transparent window sections made of a material having light transmitting properties (for example, a transparent resin) are provided in the cartridge container 12 instead of the openings 30, 32, 34 and 36 of the cartridge container 12, and in this case, openings forming air connection ports are provided separately.

Moreover, an IC memory chip 40 is mounted on the cartridge container 12 according to the present example, and attribute information such as the internal negative pressure value at the completion of ink filling, the ink fill volume, the number of filling operations, the filling date and time, and the like, are stored on this IC memory chip 40. A desirable mode is one in which the IC memory chip 40 uses a radio IC tag (Radio Frequency Identification: RFID) which is readable and writable by means of a non-contact method.

Figure 3:
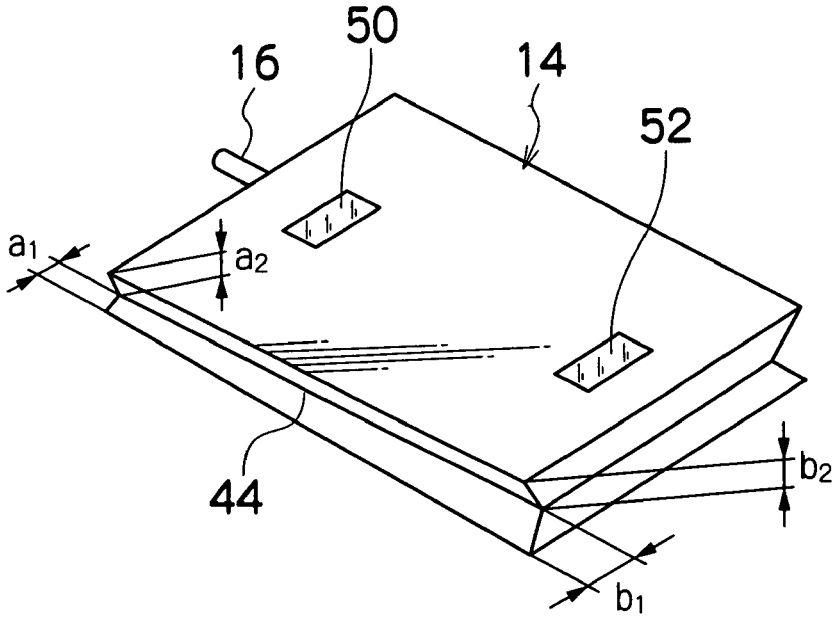
FIG. 3 is a perspective diagram of an ink bag.

FIG. 3 is a perspective diagram of the ink bag 14. As shown in FIG. 3, the ink bag 14 according to the present example has a collapsible fold 44 formed in the perimeter of the ink bag 14, thereby creating a bellows structure which is able to fold up in accordance with the amount of ink inside the ink bag 14. Moreover, the interior of the ink bag 14 is maintained in a negative pressure state due to the elastic force of the fold 44.

In the ink bag 14 shown as an example in FIG. 3, the fold 44 on the side near to the ink supply port 16 is relatively small, and the fold 44 on the side distant from the ink supply port 16 is relatively large. In other words, a composition is adopted in which, if the fold dimensions on the side face of the ink bag 14 are taken to be $a_1$ and $a_2$ in the portion of the fold 44 on the side near to the ink supply port 16, and are taken to be $b_1$ and $b_2$ in the portion of the fold 44 on the side distant from the ink supply port 16, then the relationships $a_1<b_1$ and $a_2<b_2$ are satisfied, in such a manner that the force (the elastic force of the fold 44) which generates the negative pressure becomes less gradually as the distance from the ink supply port 16 increases.

The reference numerals 50 and 52 in FIG. 3 indicate the light transmitting regions provided in the ink bag 14, and these light transmitting regions 50 and 52 are provided at positions corresponding to the positions of the openings 30 and 32 in the cartridge container 12 shown in FIG. 2. Although not shown in FIG. 3, light transmitting regions are also provided in a similar fashion on the rear side of the ink bag 14, in positions corresponding to the respective positions of the openings 34 and 36 (see FIG. 2) on the rear surface side of the cartridge container 12. Of course, a mode is also possible in which the whole of the ink bag 14 is formed by an optically transmitting material.

In the ink cartridge 10 having the composition described above, when filling ink, firstly, the air and ink inside the ink bag 14 is made to be in the state of negative pressure and expelled, whereupon a step of filling ink from the ink supply port 16 is started. In the ink filling step, while the internal pressure of the ink bag 14 is controlled to be a specified pressure, ink is filled into the ink bag 14 in the range such that a specified negative pressure is produced (for example, a pressure at which the meniscus in the nozzles of the recording head will not break down when the cartridge is installed in an inkjet recording apparatus for operation).

After the filling, the attribute information including the value of the internal negative pressure and the ink fill volume, and the like, are written to the IC memory chip 40.

The ink cartridge 10 itself according to the present example comprises a means which generates the negative pressure (in this embodiment, the fold 44 of the ink bag 14), and hence has a merit in that it is not limited to using a pressure created by a lifting height resulting from the position of the ink cartridge 10, or the like. In other words, by setting the negative pressure generated by the ink bag 14 to a suitable value, it is possible to adopt a variety of arrangement positions for the ink cartridge 10, either above or below the nozzle surface of the ejection head.

In particular, if the positional arrangement for the ink cartridge 10 in the inkjet recording apparatus fitted with the ink cartridge 10 is one in which the direction of the flat plane of the cartridge lies horizontally, then a significant effect in reducing the height of the apparatus is obtained.

By installing the ink cartridge 10 according to the present embodiment in an inkjet recording apparatus and connecting the coupling section 18 of the cartridge to the flow channel connection port on the apparatus side (the engaging receiving section for the coupling section 18), the ink inside the ink bag 14 is extracted via the ink supply port 16. As ink is supplied to the print head in the inkjet recording apparatus from the ink bag 14, thereby consuming the ink in the ink bag 14, the ink bag 14 folds up progressively, starting from the fold 44 in the portion of the ink bag 14 that is distant from the ink supply port 16 (the portion where the elastic force is weaker).

As the amount of ink consumed increases (as the remaining amount of ink decreases), then the ink bag 14 gradually collapses, but since the elastic force of the fold 44 is relatively stronger in the portion near to the ink supply port 16, then this portion is not liable to collapse until the very last, and therefore the region near to the ink supply port 16 is not liable to become sealed. Consequently, it is possible to consume the ink right up to the very last, without waste, and hence the amount of waste ink can be reduced.

Supposing that the ink bag is a simple flat ink bag made of a plastic member having a uniform negative pressure generating force, then when ink is extracted to the exterior via the ink supply port, this ink is extracted from the vicinity of the ink supply port and therefore the region in the vicinity of the ink supply port is liable to collapse first. Consequently, regardless of the fact that sufficient ink is remaining in the portion that is distant from the ink supply port, the plastic ink bag is caused to collapse in the vicinity of the ink supply port and therefore a sealed state is liable to occur. Hence, there is a drawback in that it is difficult to extract the ink in the portion of the bag that is distant from the ink supply port. In respect of this point, by adopting the ink cartridge 10 of the present embodiment, it is possible to extract the ink right up to the last, without waste, since the vicinity of the ink supply port 16 does not assume a sealed state.

Moreover, in the ink cartridge 10 according to the present embodiment, the containers (ink bag 14 and the cartridge container 12) can be reused by refilling with ink liquid. When refilling ink in order to reuse (recycle) the ink cartridge 10, information similar to that described above is written to the IC memory chip 40. However, attention is also paid to the fact that the elasticity of the fold 44 of the ink bag 14 deteriorates with repeated reuse of the ink cartridge 10. Therefore, if the amount of ink filled into the bag in order to achieve the specified negative pressure shows an error exceeding a designated amount with respect to the amount of ink upon initial filling, it is judged that recycling is not possible and the ink bag 14 is replaced, or the like.

Composition for Determining the Remaining Amount of Ink

As described in FIG. 2, in the present embodiment, at least one portion of the ink bag 14 is made of an optically transmitting material and is therefore composed in such a manner that light can be transmitted by passing through the flat ink bag 14 in the thickness direction of the flat ink bag 14. The light-emitting elements 20 and 22 are disposed on one side of the ink bag 14 via the light transmission path, and the photoreceptor elements 24 and 26 are disposed on the opposite side of the ink bag 14, facing the light-emitting elements 20 and 22. The amount of light received by the photoreceptor elements 24 and 26 (the amount of light transmitted via the ink bag 14 and the ink liquid) is dependent on the thickness of the ink bag (the external thickness of the ink bag including the thickness of the ink bag itself and the thickness of the ink liquid remaining in the ink bag). Therefore, data which indicates the correlation between the value of the determination signals output from the photoreceptor elements 24 and 26 (for example, the value of the voltage signal) and the remaining amount of ink is prepared in advance, and the remaining amount of ink can be identified (determined) on the basis of this correlation data and the determination signals obtained from the photoreceptor elements 24 and 26.

In the case of an ink cartridge 10 which is flat in terms of the thickness direction in which light from the light-emitting elements 20 and 22 passes, it is possible to achieve good determination accuracy by setting the thickness to a value of 5 mm or less, with respect to ink having a coloring material content of 3%.

Furthermore, a desirable mode is one where a plurality of devices for determining the remaining amount of ink (pairs including a light-emitting element and a photoreceptor element) are disposed at different distances from the ink supply port 16, as in the example shown in FIG. 2. As stated above, as the ink is used (consumed), the contraction in the thickness of the ink bag 14 proceeds from the side distant that is from the ink supply port 16, and when the remaining amount of ink has fallen by a certain amount, the contraction in the thickness of the ink bag increases in the region near to the ink supply port 16.

Since the amount of light transmitted through the ink bag 14 is inversely proportional to the thickness of the ink bag 14, then by providing a device which determines the thickness of the ink bag (a pair comprising a light-emitting element and a photoreceptor element) in a plurality of positions at different distances from the ink supply port 16, and by using the information obtained from the plurality of determination devices (the determination signals from the plurality of photoreceptor elements), it is possible to determine the remaining amount of ink accurately, in a continuous fashion, from the start of use of the ink cartridge 10 (the initial filling amount) until the end of use (the level at which the ink runs out and replacement of the cartridge becomes necessary).

According to the ink determination device in the present embodiment, due to the contraction effect caused by the negative pressure generating mechanism of the ink bag, excellent determination accuracy is achieved even in a state where the remaining amount of ink is low.

Furthermore, in the case of determination based on an actuator as proposed in the related art, since determination is based on a contact method, then when the cartridge is detached or attached, the determination error increases depending on the state of volume deformation. However, the ink determination device in the present embodiment uses a non-contact type (optical type) of detector, and the ink bag maintains a uniform volume deformation due to the negative pressure generating mechanism of the ink bag. Therefore, it is possible to reduce the determination error, even in the case of repeated attachment and detachment.

The composition in the present embodiment uses an optical non-contact type of determination system, and therefore the determination elements (light-emitting elements and photoreceptor elements) can be disposed in the main body of the inkjet recording apparatus and hence they do not impair the operation performance of installing the ink cartridge. Furthermore, since the determination elements and the electrodes used for determination, and the like, are not provided on the ink cartridge, then it is possible to reduce the costs of the ink cartridge, which is a consumable item.

In the example described above, a negative pressure is generated by the elasticity of the fold in the ink bag 14 itself, but the mode of the negative pressure generating device is not limited to this example, and a mode is also possible in which, instead of the fold 44 or in combination with the fold 44, a spring member forming a negative pressure generating member is installed.

In the example described above, the force of impulsion of the negative pressure generating device constituted by the fold of the ink bag 14, acting in the negative pressure direction, reduces continuously as the distance from the ink supply port 16 increases. When implementing the present invention, the impelling force in the direction related to the negative pressure is not necessarily required to be continuously reduced, and the configuration may be formed in such a manner that the impelling force becomes lower in a stepwise fashion, that is two stages or multiple stages. For example, in a case where a leaf spring is used as the negative pressure generating device, then within the range of the width of the leaf spring, a broadly uniform force of impulsion can be obtained, but by adopting a combination with portions where no leaf spring is present or portions where leaf springs of low force are provided, it is possible to achieve a composition in which the impelling force in the negative pressure direction reduces in a stepwise fashion in the ink bag as a whole, as the distance from the vicinity of the ink supply port 16 gradually increases.

Figure 4:
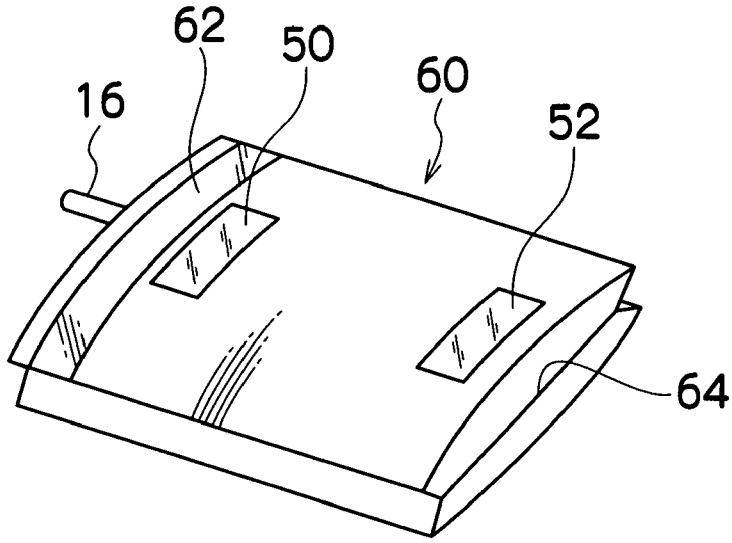
FIG. 4 is a perspective diagram showing a further mode of the ink bag.

FIG. 4 is a perspective diagram showing a further modification example of the ink bag. In FIG. 4, elements which are the same as or similar to the elements shown in FIG. 3 are labeled with the same reference numerals and description thereof is omitted here.

The ink bag 60 shown in FIG. 4 comprises a leaf spring 62 provided on the side near to the ink supply port 16, and by means of this leaf spring 62, the ink bag 60 is impelled in a direction which expands the volume thereof (a negative pressure generating direction). A leaf spring is not provided in the portion distant from the ink supply port 16, and this portion is able to fold up by means of a fold 64 formed in the end face.

Figure 5A:
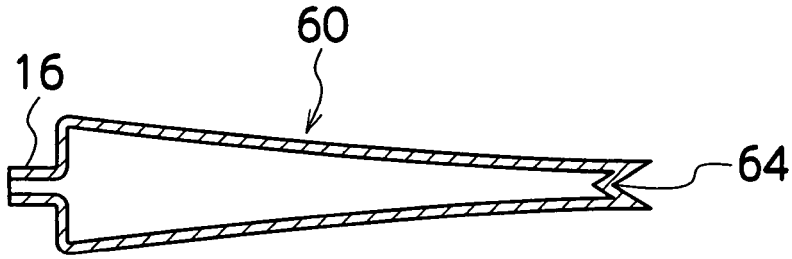
FIGS. 5A and 5B are cross-sectional diagrams illustrating the mode of deformation of an ink bag.
Figure 5B:
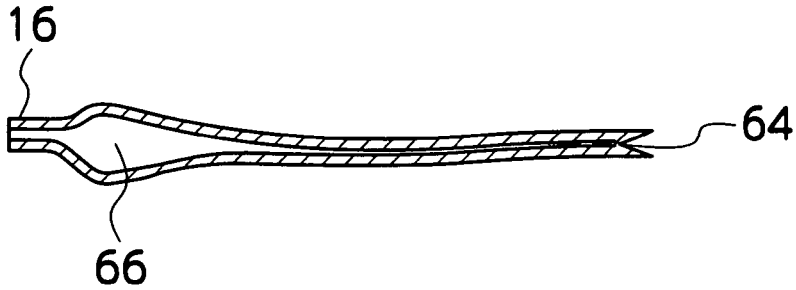

By adopting this ink bag 60, as shown in FIGS. 5A and 5B, the ink bag deforms and folds up successively from the portion that is distant from the ink supply port 16, as the amount of ink therein decreases, and with the vicinity of the ink supply port 16 not being crushed, the shape of the ink accommodating space 66 connected to the ink supply port 16 is preserved and the region in the vicinity of the ink supply port 16 does not collapse until the very last. Consequently, the ink supply port 16 is not sealed off and the ink can be extracted completely without waste.

Figure 6:
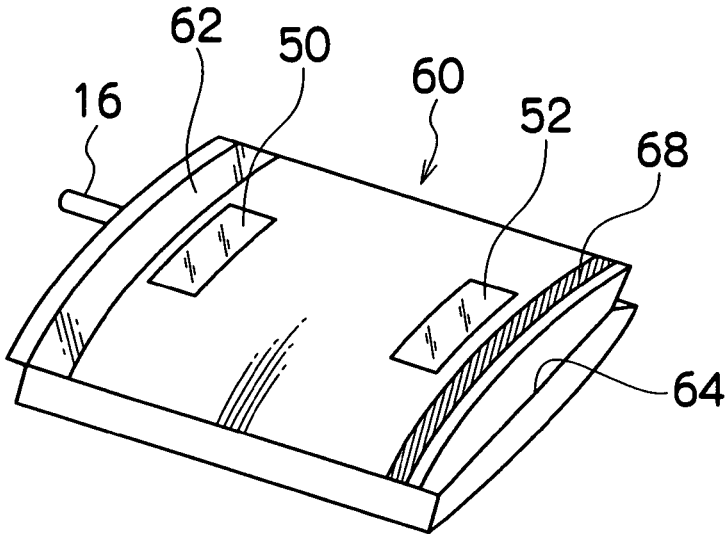
FIG. 6 is a perspective diagram showing a further mode of the ink bag.

A mode is also possible in which, instead of the composition shown in FIG. 4, a leaf spring 68 is also provided in a position that is distant from the ink supply port 16 as shown in FIG. 6. In this case, the impelling force of the leaf spring 68 is lower than the impelling force of the leaf spring 62 near to the ink supply port 16. In FIG. 6, elements which are the same as or similar to the elements shown in FIG. 4 are labeled with the same reference numerals and description thereof is omitted here.

Figure 7:
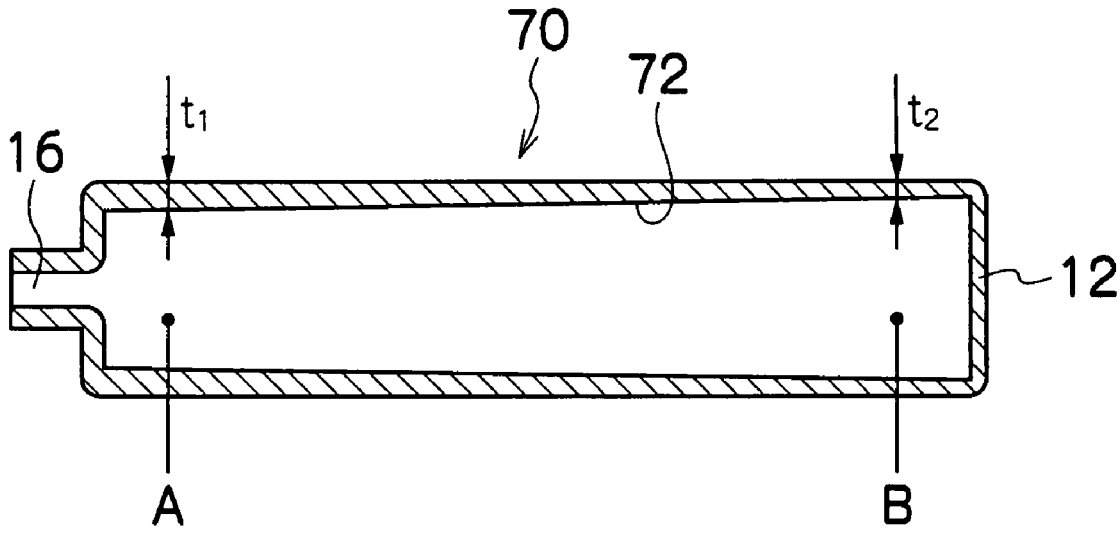
FIG. 7 is a cross-sectional diagram showing a further mode of the ink bag.

FIG. 7 is a cross-sectional diagram showing yet a further mode of the ink bag.

In the ink bag 70 depicted in FIG. 7, the whole of the ink accommodating section 72 is made of an elastic body, and the elastic force (spring constant) of the portion nearer to the ink supply port 16 is relatively larger, while the elastic force (spring constant) of the portion further from the ink supply port 16 is relatively smaller. More specifically, the ink bag 70 is composed in such a manner that the thickness of the ink bag 70 which is made of a single elastic material, gradually becomes thinner as the distance from the ink supply port 16 increases.

As shown in FIG. 7, taking the thickness in a portion (A portion) near to the ink supply port 16 to be $t_1$, and taking the thickness in a portion (B portion) distant from the ink supply port 16 to be $t_2$, then the thickness of the A portion $t_1$ is greater than the thickness of the B portion $t_2$, in other words, $t_1>t_2$. The amount of displacement of the elastic body changes in proportion to the third power of the thickness, and therefore by setting the thicknesses $t_1$ and $t_2$ of the ink bag 70 in such a manner that "$0.5\times t_1^3 \approx t_2^3$" is satisfied, the B portion is about two times as liable to deform as the A portion, at the same pressure.

FIG. 7 depicts an embodiment in which the thickness of the ink bag is varied, but it is also possible to differentiate the material composition of the ink bag in the portion near to the ink supply port from the material composition of the ink bag in the portion distant from the ink supply port so as to alter the elastic force (spring constant) between the portion near to the ink supply port and the portion distant from the ink supply port.

By means of a composition of this kind also, it is possible to cause the ink bag to deform successively from the portion distant from the ink supply port due to the consumption of the ink while maintaining the negative pressure of the ink bag, and therefore it is possible to consume the ink without waste.

Ink Cartridge Arrangement Configuration and Control of Negative Pressure

Figure 8:
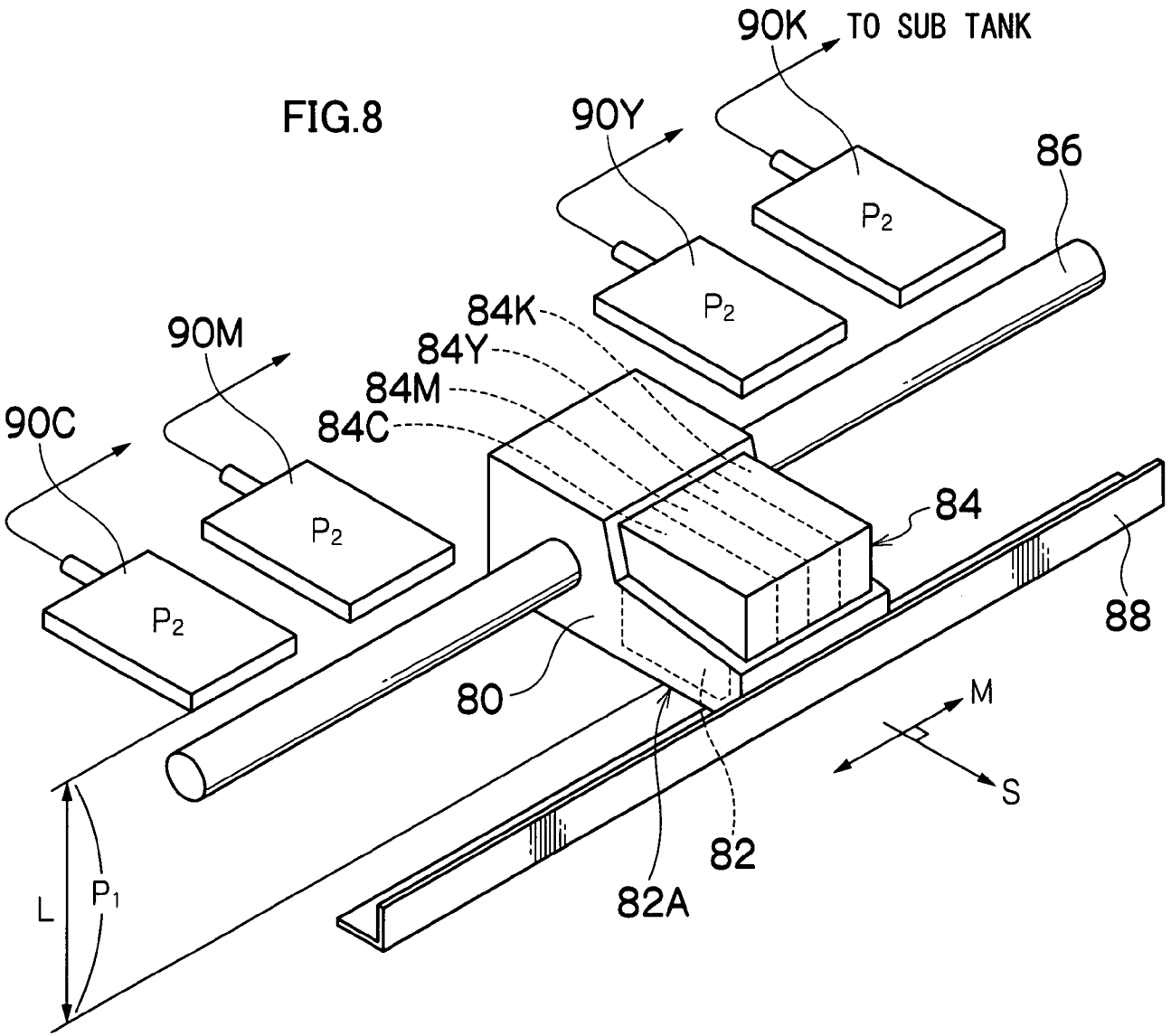
FIG. 8 is a principal schematic drawing of an inkjet recording apparatus relating to an embodiment of the present invention.

FIG. 8 is a principal perspective diagram showing an example of the composition of the peripheral part of a head section of a serial scanning type of inkjet recording apparatus which uses an ink cartridge relating to an embodiment of the present invention.

In FIG. 8, the reference numeral 80 indicates a carriage, 82 indicates a head unit, 84 indicates a sub tank unit, 86 indicates a guide shaft, and 88 indicates a guide rail. The carriage 80 on which the head unit 82 is mounted is supported on the guide shaft 86, so as to be smoothly movable in a reciprocal fashion in the main scanning direction (arrow M direction), along the guide shaft 86 and the guide rail 88 parallel to same, while maintaining a uniform distance between the recording medium (not illustrated) and the nozzle surface.

The sub tank unit 84 is disposed above the head unit 82 on the carriage 80. The sub tank unit 84 comprises sub tanks 84C, 84M, 84Y and 84K for the respective colors, which store the inks of the respective colors of C, M, Y and K. The sub tanks 84C, 84M, 84Y and 84K of the respective colors are connected to the print head 82 via flow channel forming members (not shown), and are also connected to the ink cartridges 90C, 90M, 90Y and 90K of the respective corresponding colors.

The inks supplied from the ink cartridges 90C, 90M, 90Y and 90K of the respective colors are stored in the sub tanks 84C, 84M, 84Y and 84K of the respective corresponding colors, and are then supplied to the head unit 82 provided below same.

Although not shown in FIG. 8, the head unit 82 comprises nozzle rows for ejecting inks of the respective colors of cyan (C), magenta (M), yellow (Y) and black (K). The nozzle rows of the respective colors are arranged in such a manner that the plurality of nozzles which eject ink of the same color are arranged in the conveyance direction of the recording medium (not illustrated) (namely, the sub-scanning direction indicated by arrow S in FIG. 8). In other words, the head unit 82 has a C nozzle row in which C nozzles for ejecting C ink are aligned in the sub-scanning direction, an M nozzle row in which M nozzles for ejecting M ink are aligned in the sub-scanning direction, a Y nozzle row in which Y nozzles for ejecting Y ink are aligned in the sub-scanning direction, and a K nozzle row in which K nozzles for ejecting K ink are aligned in the sub-scanning direction, the C, M, Y and K nozzle rows being arranged in row units in the main scanning direction that is perpendicular to the sub-scanning direction (the direction indicated by arrow M in FIG. 8).

Figure 9:
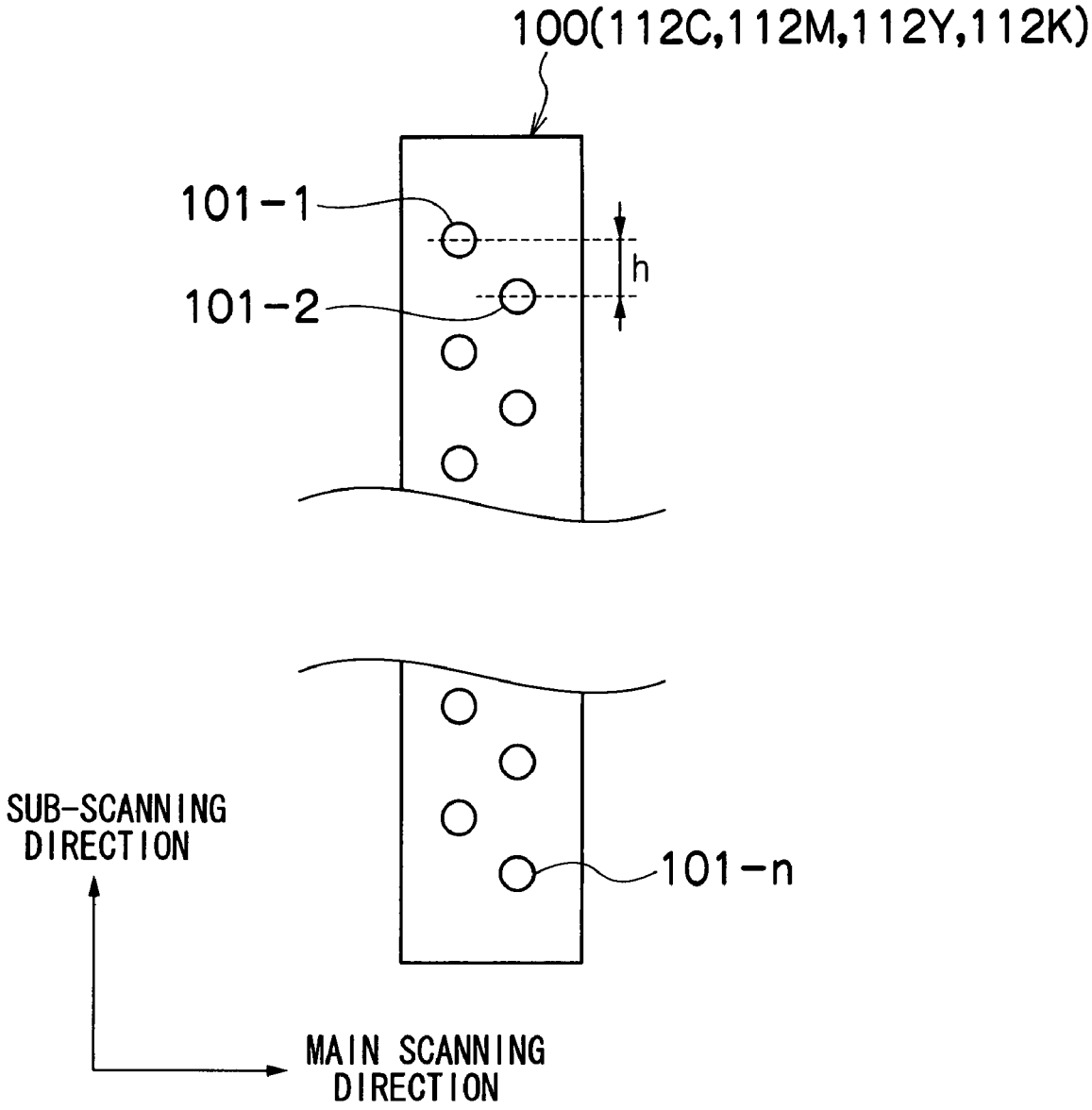
FIG. 9 is a diagram showing an example of a nozzle arrangement in a print head.

FIG. 9 is a diagram showing an example of the nozzle arrangement in the head section 82. The print heads corresponding to the inks of the respective colors have the same structure and therefore a representative print head is indicated by the reference numeral 100.

The print head 100 has n nozzles 101 (101-1 to **101-*n*) and these n nozzles are arranged in a staggered configuration in two rows. By arranging the nozzles 101 in a staggered configuration in this fashion, it is possible to reduce the pitch between nozzles in the effective nozzle row obtained by projecting the nozzles to an alignment in the sub-scanning direction (for example, to reduce the distance h in the sub-scanning direction between the nozzle 101-1 and the nozzle 101-2 in FIG. 9**).

Figure 10:
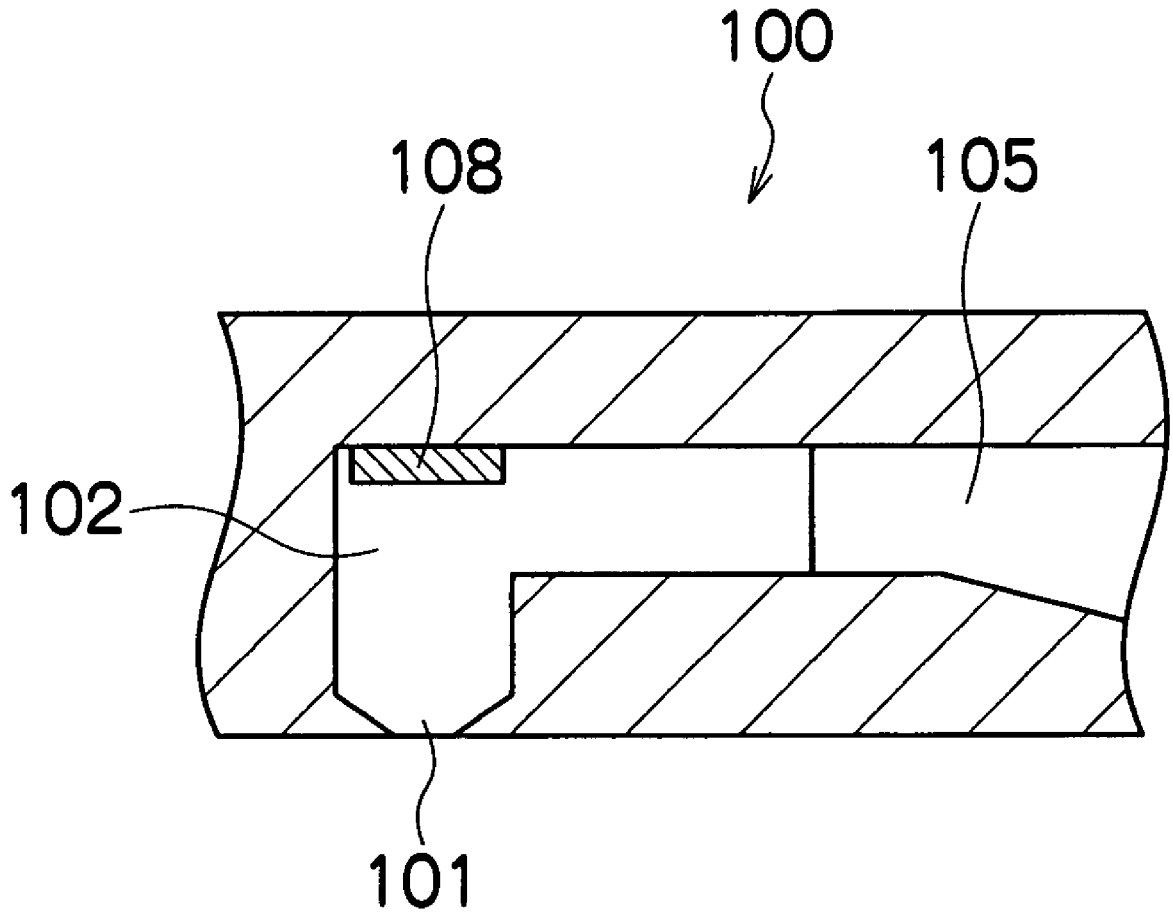
FIG. 10 is a cross-sectional diagram showing an example of the internal structure of the print head.

FIG. 10 is a cross-sectional diagram showing the composition of a droplet ejection element corresponding to one nozzle (one channel). Each nozzle 101 is connected to a pressure liquid chamber 102 which accommodates ink, and furthermore, the pressure liquid chambers 102 in the head are connected to a common flow channel 105 which supplies ink to the plurality of pressure liquid chambers 102. The common flow channel 105 is connected to the sub tank unit 84 (see FIG. 8) corresponding to the colors, and ink for ejection is supplied to each of the pressure liquid chambers 102 from the sub tank unit 84, via the common flow channel 105 shown in FIG. 10.

Furthermore, as shown in FIG. 10, a pressurization element (here, a heater) 108 is provided inside each pressure liquid chamber 102, as a device which pressurizes the ink inside each pressure liquid chamber 102. By driving the pressurization element 108, the ink inside the pressure liquid chamber 102 is made to assume a boiling state, thereby generating a bubble, and ink is ejected from the nozzle 101 due to the pressure of the generated bubble. In other words, the print head 100 shown in the present embodiment employs a thermal method which uses the pressure of a gas bubble generated in the pressure liquid chamber due to the heating energy of a heater, as a force for ejecting ink.

In the present example, independent print heads (C head, M head, Y head and K head) are provided for the respective ink colors, and the head unit 82 (C, M, Y, K heads) is composed by combining together this plurality of print heads; however, instead of this composition, it is also possible to adopt a composition in which the internal flow channels of one single print head are separated according to the colors (a flow channel structure separated into color units), in such a manner that inks of a plurality of colors can be ejected from one single print head.

In the composition shown in FIG. 8, the ink cartridges 90C, 90M, 90Y and 90Y of the respective colors are disposed further above the sub tank unit 84 on the head unit 82, in the inkjet recording apparatus, and the (four) ink cartridges 90C, 90M, 90Y and 90K of the respective colors are arranged in one row in the same plane following the main scanning direction, the flat planar surface of the each ink cartridge being maintained in a substantially horizontal state.

If the height from the ejection surface (nozzle surface 82A) of the head section 82 until the ink cartridges 90C, 90M, 90Y and 90K is taken to be L, the hydraulic head pressure differential (liquid head pressure differential: symbol +), to be P1, the negative pressure value inside the ink cartridge (symbol −), to be P2, and the internal pressure P3 of the nozzle surface of the head unit, to be P3, then desirably, P3 is set in the range of −20 mm $H_2O$ to −70 mm $H_2O$. Since 1 mm $H_2O$ is approximately 9.8 Pa (Pascal), then when expressed in units of Pa (Pascal), P3 is desirably set to a range of −196 Pa to −686 Pa.

In other words, the cartridge position (the height position in the vertical direction with reference to the nozzle surface of the head, namely L in FIG. 8), and the negative pressure value inside the cartridge are set in order to satisfy the following relationship.

The pressure P3 at the nozzle liquid surface of the head=(the pressure due to the height of the hydraulic head of the ink cartridge from the nozzle surface of the head: P1)+(the internal pressure of the ink cartridge: P2)

As shown in FIG. 8, if the ink cartridges 90C, 90M, 90Y and 90K are disposed above the nozzle surface 82A of the head unit 82 in the vertical direction, then the hydraulic head pressure differential (P1) acts in the positive (+) direction, and therefore the impelling force of the internal pressure generating devices of the ink cartridges 90C, 90M, 90Y and 90K is set in such a manner that the internal pressure of the ink cartridge absorbs this hydraulic head pressure differential acting in the positive direction and in such a manner that the pressure at the nozzle liquid surface of the head is in the specified range (for example, −20 mm $H_2O$ to −70 mm $H_2O$).

Figure 11:
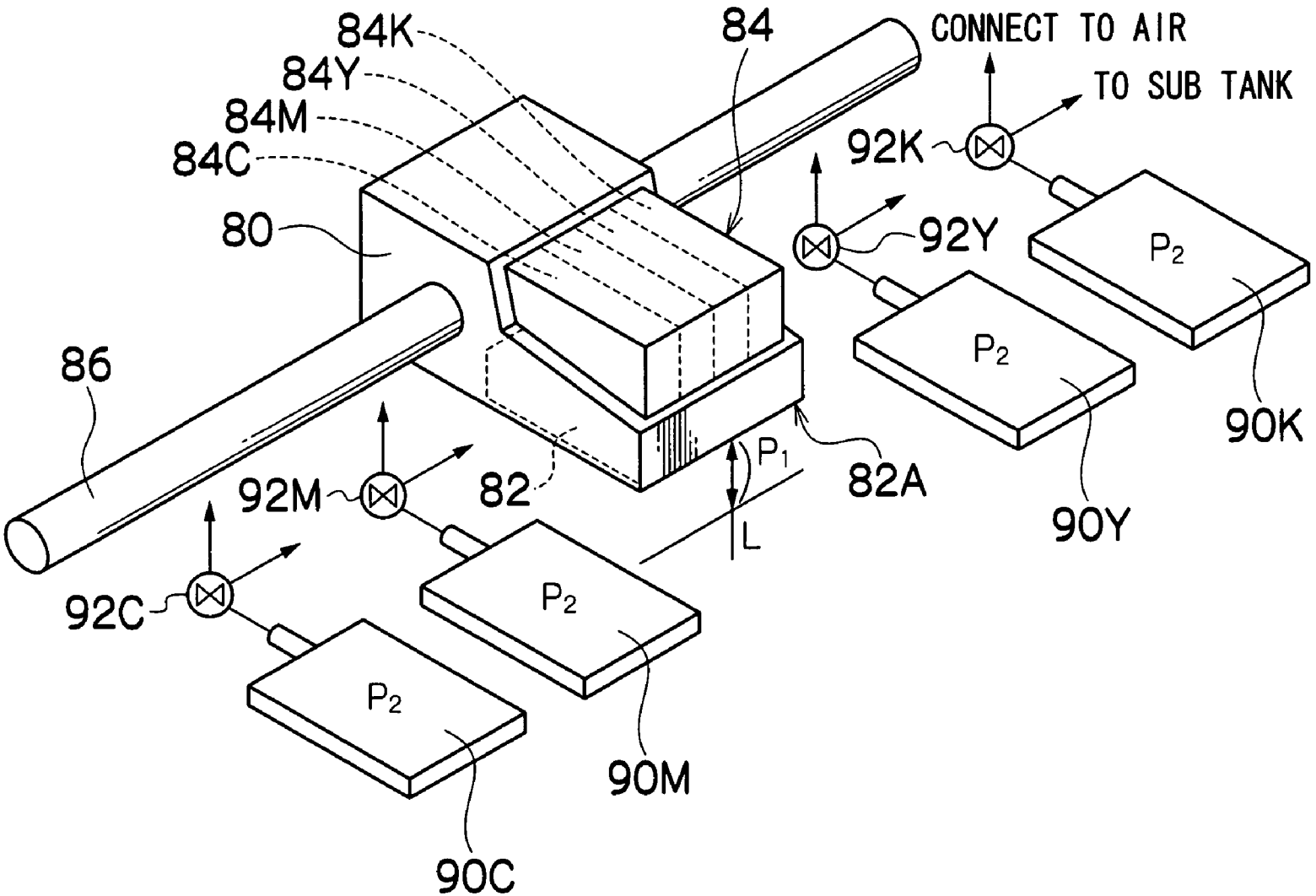
FIG. 11 is a principal schematic drawing of an inkjet recording apparatus relating to a further embodiment of the present invention.

FIG. 11 is a principal perspective diagram showing a further composition of an inkjet recording apparatus which uses an ink cartridge relating to an embodiment of the present invention.

The composition depicted in FIG. 11 differs from the example shown in FIG. 8 in respect of the fact that the ink cartridges are arranged below the nozzle surface of the head in the vertical direction. In FIG. 11, elements which are the same as or similar to those of the example in FIG. 8 are labeled with the same reference numerals and description thereof is omitted here.

As in the composition shown in FIG. 11, if the ink cartridges 90C, 90M, 90Y and 90K are disposed below the nozzle surface 82A of the head unit 82 in the vertical direction, then the hydraulic head pressure differential (P1) acts in the negative (−) direction, but the internal pressure of the ink cartridge is adjusted by setting the impelling force of the internal negative pressure generating device in such a manner that the pressure at the nozzle surface of the head comes within a specified range.

In other words, the ink cartridge position (the height position in the vertical direction with reference to the nozzle surface of the head, namely L in FIG. 11), and the negative pressure value inside the cartridge are set in order to satisfy the following relationship.

(The pressure at the nozzle surface of the head: P3)=(the pressure due to the height of the hydraulic head in the ink cartridge from the nozzle surface of the head: P1)+(the internal pressure of the ink cartridge: P2).

Furthermore, valves (air connection valves) 92C, 92M, 92Y and 92K which are able to connect to the outside air are provided at intermediate positions in the flow channels which connect the respective ink cartridges 90C, 90M, 90Y and 90K to the sub tanks 84C, 84M, 84Y and 84K (and more desirably, in the vicinity of the ink supply ports 16 of the respective ink cartridges 90C, 90M, 90Y and 90K). If the end of the remaining amount of ink (the limit of the remaining amount of ink at which ink cannot be extracted any further from the ink bag) is determined in any of the ink cartridges 90C, 90M, 90Y and 90K, then it is possible to extract the ink inside the ink supply channels, to the head unit 82, by opening the air connection valves 92C, 92M, 92Y and 92K of corresponding ink cartridges 90C, 90M, 90Y, and 90K (by connecting the air connection valves 92C, 92M, 92Y and 92K to the air). Consequently, it is possible to use up the ink inside the ink flow channels, without waste.

As described in FIG. 8 and FIG. 11, by adopting the ink cartridge according to the present embodiment and by appropriately setting the arrangement height and the internal negative pressure of the flat ink cartridges, beneficial effects are obtained in improving the freedom of arrangement of the ink cartridges, and it is possible to reduce the height of the apparatus.

Application Example of Inkjet Recording Apparatus in Pit-Stop Ink Supply System

Figure 12:
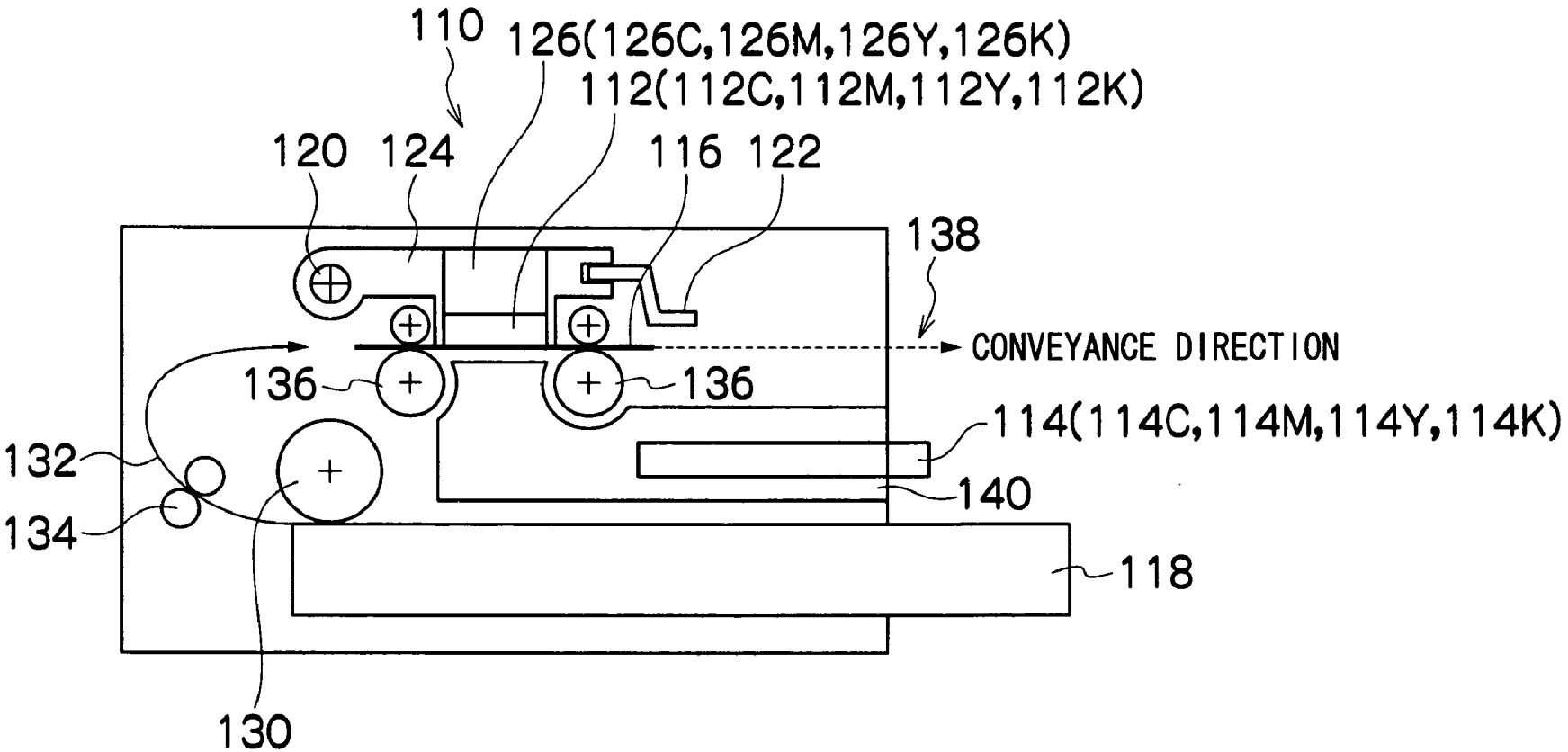
FIG. 12 is a general schematic drawing of an inkjet recording apparatus relating to a further embodiment of the present invention.

FIG. 12 is a diagram of the composition of an inkjet recording apparatus relating to an embodiment of the present invention. As shown in FIG. 12, this inkjet recording apparatus 110 comprises: a head unit 112 having a plurality of print heads 112C, 112M, 112Y and 112K, provided for respective colors of ink; ink cartridges 114 (114C, 114M, 114Y and 114K) which store inks to be supplied to the respective print heads 112C, 112M, 112Y and 112K; a paper supply unit 118 which supplies recording paper 116; a carriage 124 which moves the head unit 112 for scanning along a guide rail 122, while being supported by guide shafts 120, in a main scanning direction which is substantially perpendicular to the conveyance direction of the recording medium; and negative pressure maintaining units 126 (126C, 126M, 126Y and 126K), provided in equal number to the print heads, which couple respectively with the print heads 112K, 112C, 112M and 112Y of the respective colors in the head unit 112, and generate a negative pressure inside the respective print heads 112K, 112C, 112M and 112Y.

The structure of the print heads 112C, 112M, 112Y and 112K of the respective colors are similar to the examples described in FIG. 9 and FIG. 10, and description thereof is omitted here.

The paper supply unit 118 in FIG. 12 uses a system based on a paper supply cassette which is loaded with cut paper that has been cut to a prescribed size. In order to print onto recording papers 116 of a plurality of sizes, the paper supply cassette fitted to the paper supply unit 118 is removed and replaced with a paper supply cassette loaded with recording paper 116 of the desired size. It is also possible to prepare cassettes loaded with recording papers 116 of the same size but different paper types.

In this way, the inkjet recording apparatus 110 is composed in such a manner that it can be used with recording papers of a plurality of types, and by attaching an information recording body, such as a barcode or radio tag, which stores type information relating to the loaded recording paper 116, to the cassette, and reading in the information of this information recording body, by means of a prescribed reading apparatus, the inkjet recording apparatus 110 is able to judge automatically the type of paper being used, and hence the various units in the apparatus can be controlled in accordance with the type of paper. For example, ink ejection is controlled in such a manner that suitable ink ejection is achieved in accordance with the type of recording paper 116.

The recording paper 116 loaded in the paper supply unit 118 is conveyed to the conveyance path 132 by the rotation of the paper supply roller 130, and is then conveyed in the upward vertical direction by the conveyance rollers 134 provided in the conveyance path 132, while at the same time the front/rear surface orientation of the paper is reversed in the conveyance path 132 (the paper is turned once in the conveyance path 132) and the paper is conveyed to a position directly below the head unit 112. The recording paper 116 is then conveyed directly below the head unit 112 in a prescribed conveyance direction within a horizontal plane (the sub-scanning direction, indicated by the arrow in FIG. 1), at a uniform conveyance pitch, while being kept to a prescribed flatness by the conveyance rollers 136.

When the recording paper 116 arrives at a print region directly below the head unit 112, then printing in the main scanning direction is carried out by ejecting inks of respective colors from the nozzles provided in the surfaces of the print heads 112K, 112C, 112M and 112Y which face the recording paper 116, while moving the carriage 124 for scanning in the main scanning direction. When one printing action in the main scanning direction has finished, the recording paper 116 is conveyed through a prescribed distance in the sub-scanning direction, and printing in the main scanning direction is carried out again while moving the carriage in the main scanning direction. In this way, by repeating a printing action in the main scanning direction while conveying the recording paper 116 successively through a uniform pitch in the sub-scanning direction, a desired image is recorded on the whole surface of the recording paper 116. The recording paper 116 on which the desired image has been formed is then conveyed in a prescribed conveyance direction and output to the exterior of the apparatus from the paper output unit 138.

The ink cartridges 114 which store inks to be supplied respectively to the respective print heads 112K, 112C, 112M and 112Y (the C ink cartridge 114C corresponding to the C ink, the M ink cartridge 114M corresponding to the M ink, and the Y ink cartridge 114Y corresponding to the Y ink; the K ink cartridge 114K corresponding to the K ink, referred to jointly as the ink cartridge(s) 114 below), are installed via ink cartridge introduction apertures (not illustrated in FIG. 12 and the reference numeral 142C, 142M, 142Y and 142K in FIG. 13) provided in a sub cartridge 140 which is separable from the main body of the apparatus.

The inkjet recording apparatus 110 in the present embodiment has a structure in which the sub cartridge 140 in which ink cartridges 114 are installed can be attached and detached to and from the main body of the apparatus via the front side of the apparatus. Furthermore, ink cartridge introduction apertures 142C, 142M, 142Y and 142K for inserting the ink cartridges 114 are provided on the front surface of the sub cartridge 140 (the surface of the sub cartridge 140 which corresponds to the front surface of the apparatus when the sub cartridge 140 is installed in the main body of the apparatus), thereby forming a structure in which the operation of detaching and attaching (replacing) the ink cartridges 114 can be carried out via the front surface of the apparatus.

Description of Sub Cartridge

Figure 13:
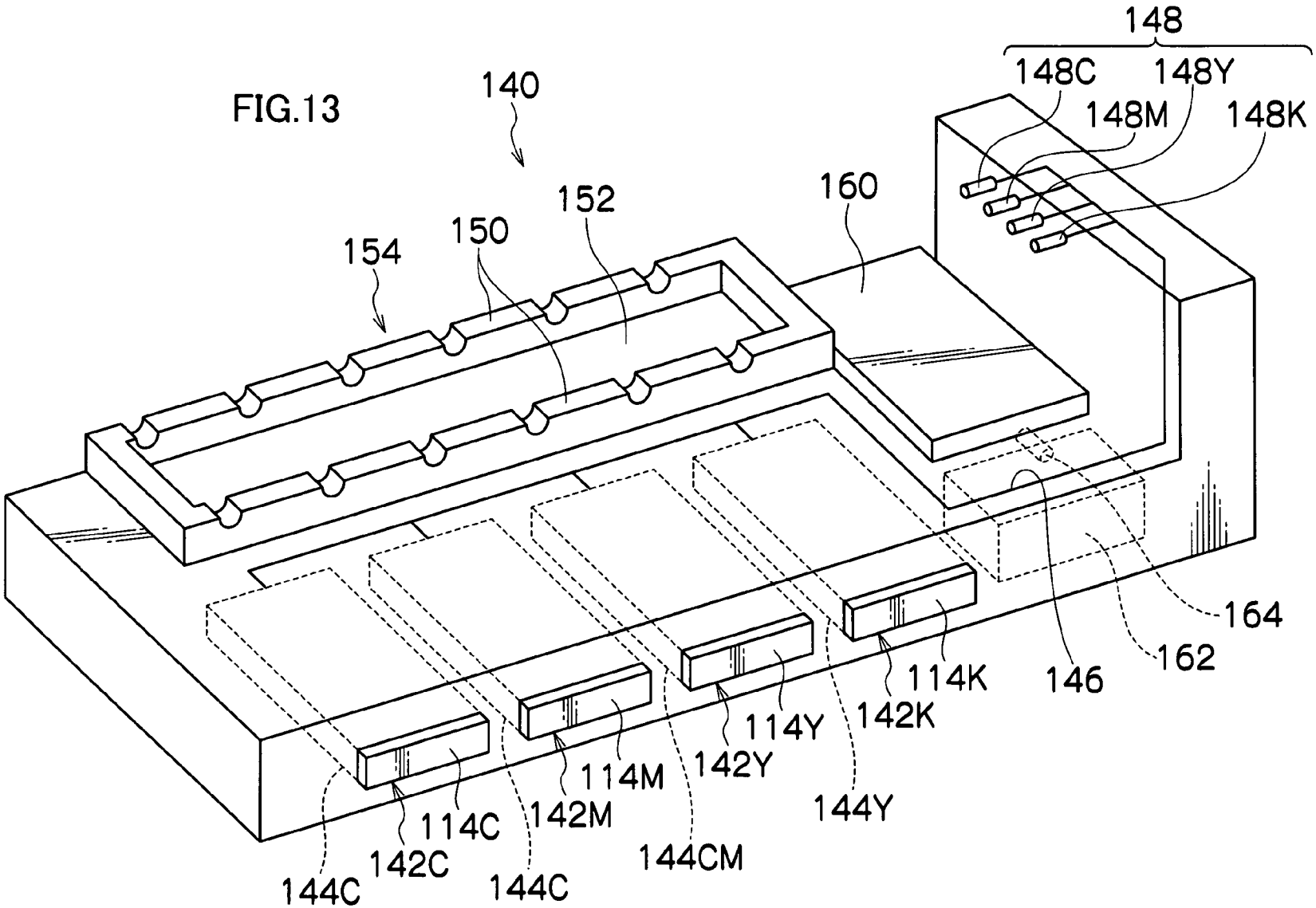
FIG. 13 is a perspective diagram of a sub cartridge which is installed in the inkjet recording apparatus in FIG. 12.
Figure 14:
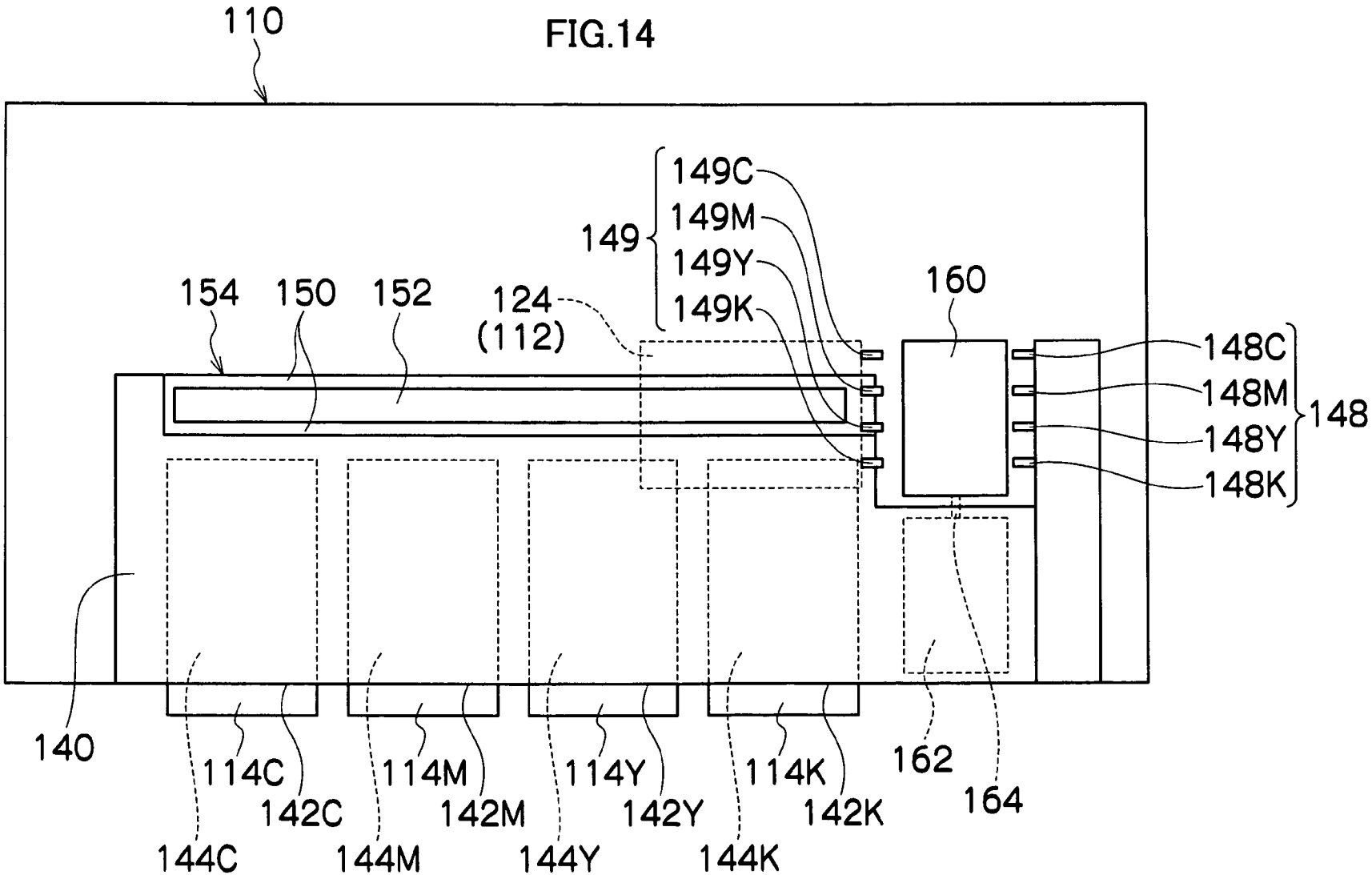
FIG. 14 is a plan diagram of the sub cartridge which is installed in the inkjet recording apparatus in FIG. 12.

Next, the composition of the sub cartridge is described below. FIG. 13 shows an oblique diagram of the sub cartridge 140, and FIG. 14 is a plan diagram showing the sub cartridge 140 in an installed state in the main body of the inkjet recording apparatus 10, as viewed from the upper side of the apparatus. In order to clarify the depiction of the sub cartridge 140, FIG. 14 does not depict a detailed illustration of the head unit 112 and the scanning mechanism.

As shown in FIG. 13, the sub cartridge 140 comprises the ink cartridge introduction apertures 142C, 142M, 142Y and 142K on the front surface.

When the ink cartridges 114C, 114M, 114Y and 114K are installed on the ink cartridge installation units 144C, 144M, 144Y and 144K via the ink cartridge introduction apertures 142C, 142M, 142Y and 142K, then the ink cartridges 114C, 114M, 114Y and 114K connect with ink supply coupling sections 148 (148K, 148C, 148M, and 148Y) via the ink supply channel 146 provided inside the sub cartridge 140. In FIG. 13, in order to simplify the illustration, the ink supply channel 146 is depicted schematically by means of a single line, but in fact, ink flow channels corresponding to the inks of the respective colors are provided independently inside the sub cartridge 140.

The ink supply coupling sections 148 are provided on one end portion of the scanning region of the head unit 112, in a state where the sub cartridge 140 is installed in the main body of the inkjet recording apparatus. Coupling sections 149 which can be respectively coupled to and separated from the ink supply coupling sections 148 of the sub cartridge 140 are provided in the end section of the head unit 112 (see FIG. 14).

The inkjet recording apparatus 110 shown in the present example employs a "pit stop" ink supply system in which, when it becomes necessary to refill ink into the head unit 112, the carriage 124 is moved to the end of the scanning region where the ink supply coupling sections 148 are provided, the coupling sections 149 are connected to the ink supply coupling sections 148, and ink is thereby supplied from the sub cartridge 140 to the head unit 112.

The position of the head unit 112 when the coupling sections 149 of the head unit 112 are fitted and coupled with the ink supply coupling sections 148 of the sub cartridge 140 is called the home position, and the driving of the carriage 124 is controlled in such a manner that the head unit 112 is moved to the home position during standby for recording, at the start of print processing, at the end of print processing, or when carrying out maintenance.

The sub cartridge 140 comprises a guide member 154 which combines the functions of a conveyance guide section 150 forming conveyance guide for the recording paper (reference numeral 116 in FIG. 12) in the print region, with the functions of an ink receiving section 152 which receives ink that strays outside the width of the recording paper 116 during borderless printing. In this guide member 154, a projecting section formed in the outer edge portion of the guide member 154 acts as a conveyance guide section 150 for the recording paper in the printing region, and the region (recess section) surrounded by this conveyance guide section 150 (projecting section) forms an ink receiving section 152.

If ink or other dirt becomes attached to the guide member 154, then the user is able to remove the sub cartridge 140 for cleaning or replacement. It is desirable to use a resin material for the guide member 154. The maintenance of the ink receiving section 152 can be carried out more easily by adopting a composition in which an absorbing member which absorbs liquid, such as a porous member or nonwoven cloth, is provided in the ink receiving section 152 in such a manner that the absorbing member can be removed alone from the guide member 154 when the ink receiving section 152 has become full.

The sub cartridge 140 is provided with a restoration unit 160 comprising a cap member (not shown in FIG. 14 and reference numeral 260 in FIG. 21) which can make tight contact with the nozzle surface of the head unit 112, and a suction pump (not shown in FIG. 14 and reference numeral 288 in FIG. 21) which connects to the cap member. The restoration unit 160 is positioned directly below the nozzle surface of the head unit 112, in a state where the head unit 112 is coupled to the sub cartridge 140 (a state where the head unit 112 is situated in the home position). The details of the composition of the restoration unit 160 are described hereinafter, but before starting a print process, or when not in a printing state, for instance, during standby for printing, the cap member is placed in tight contact with the nozzle surface of the head unit 112, thereby preventing drying of the ink inside the nozzles and avoiding ejection abnormalities caused by increase in the viscosity of the ink.

Furthermore, if air bubbles have occurred inside the nozzles (or inside the head), or if removing ink of increased viscosity from the nozzles, then the cap member is placed in tight contact with the nozzle surface and the ink is suctioned from the nozzles by operating the suction pump. By means of this suction operation, new ink is supplied to the head unit 112 from the coupling sections 149 side.

The sub cartridge 140 comprises a waste ink tank (waste ink recovery section) 162 which recovers waste ink suctioned by the restoration unit 160. This waste ink tank 162 is connected to the restoration unit 160 via the waste ink flow channel 164 provided in the sub cartridge 140.

The waste ink tank 162 can be detached from the lower side of the sub cartridge 140 when the sub cartridge 140 has been removed from the main body of the apparatus. Consequently, if the waste ink tank 162 has become filled with waste ink, then it is possible to remove it from the sub cartridge 140 and replace it with a new waste ink cartridge, and hence only the waste ink tank 162 is discarded. A composition may be adopted in which the ink receiving section 152 and the waste ink tank 162 are coupled via a flow channel member, such as a tube, in such a manner that the ink collected in the ink receiving section 152 is collected into the waste ink tank 162.

By integrating and accommodating an ink supply system which supplies ink to the print heads 112C, 112M, 112Y, 112K, and an ink recovery system comprising the ink receiving section 152, the restoration unit 160 and the waste ink tank 162, within the sub cartridge 140, as described above, then the user is easily able to carry out maintenance tasks relating to the ink tubing and the waste ink.

Figure 15:
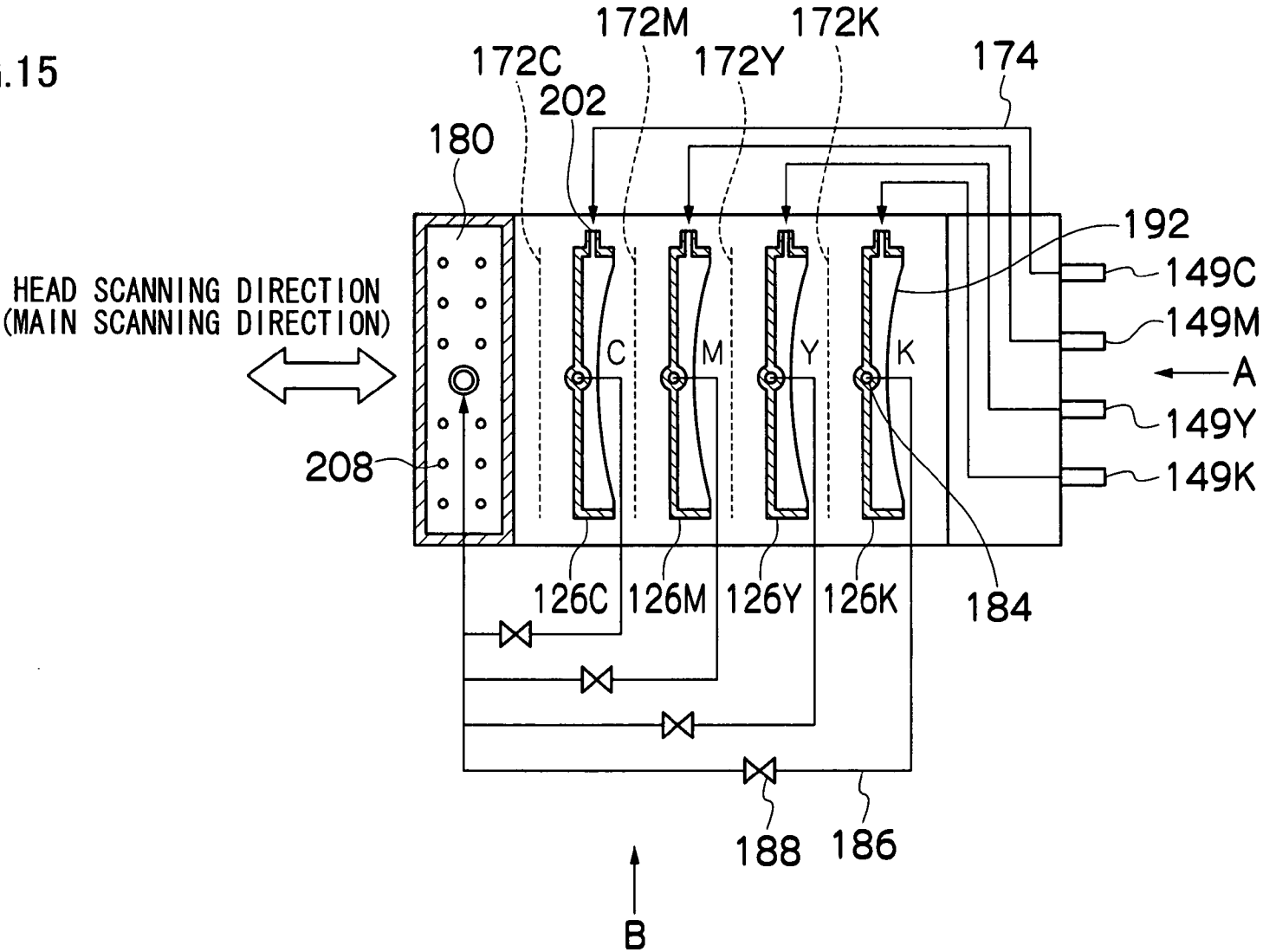
FIG. 15 is a planar schematic drawing of a head unit.

FIG. 15 is a planar schematic drawing of the head unit 112 as viewed from above (a diagram including a partial transparent section). As shown in FIG. 15, the head unit 112 comprises a C nozzle row 172C in which a plurality of nozzles for ejecting C ink are arranged in the sub-scanning direction, an M nozzle row 172M in which a plurality of nozzles for ejecting M ink are arranged in the sub-scanning direction, a Y nozzle row 172Y in which a plurality of nozzles for ejecting Y ink are arranged in the sub-scanning direction, and a K nozzle row 172K in which a plurality of nozzles for ejecting K ink are arranged in the sub-scanning direction. Negative pressure maintaining units 126C, 126M, 126Y and 126K for the inks of the respective colors are provided so as to correspond to the nozzle rows 172C, 172M, 172Y and 172K of the respective colors, above the head unit 112.

The respective negative pressure maintaining units 126C, 126M, 126Y and 126K are connected to the corresponding coupling sections 149C, 149M, 149Y and 149K, via tubes or other suitable flow channel forming members (indicated by reference numeral 174 in FIG. 15). Below, in order to simplify the description, the reference numeral 126 is used to indicate the negative pressure maintaining units 126C, 126M, 126Y and 126K, without specifying any color in particular. Similarly, the reference numeral 149 is used to indicate the coupling sections 149C, 149M, 149Y and 149K, without specifying any color in particular.

A bubble expulsion chamber 180 is provided in one end section of the head unit 112 in the main scanning direction (the end section on the opposite side to the side where the coupling sections 149 are formed), and an expulsion port 184 formed in the upper portion of each negative pressure maintaining unit 126 is connected to the bubble expulsion chamber 180 via a bubble expulsion flow channel 186 formed by a tube or other suitable flow channel forming material, and a non-reversing valve 188. It is also possible to use a valve (opening and closing valve) which can be controlled to open and close, instead of the non-reversing valve 188.

Furthermore, a plurality of openings (bubble expulsion holes 208) are formed in the bottom face of the bubble expulsion chamber 180, and the bubbles are suctioned out by placing the cap of the restoration unit 160 described below (reference numeral 260 in FIG. 21) in tight contact with the bottom face and creating a vacuum by means of a suction pump (reference numeral 288 in FIG. 21).

Description of Negative Pressure Maintaining Unit

Figure 16:
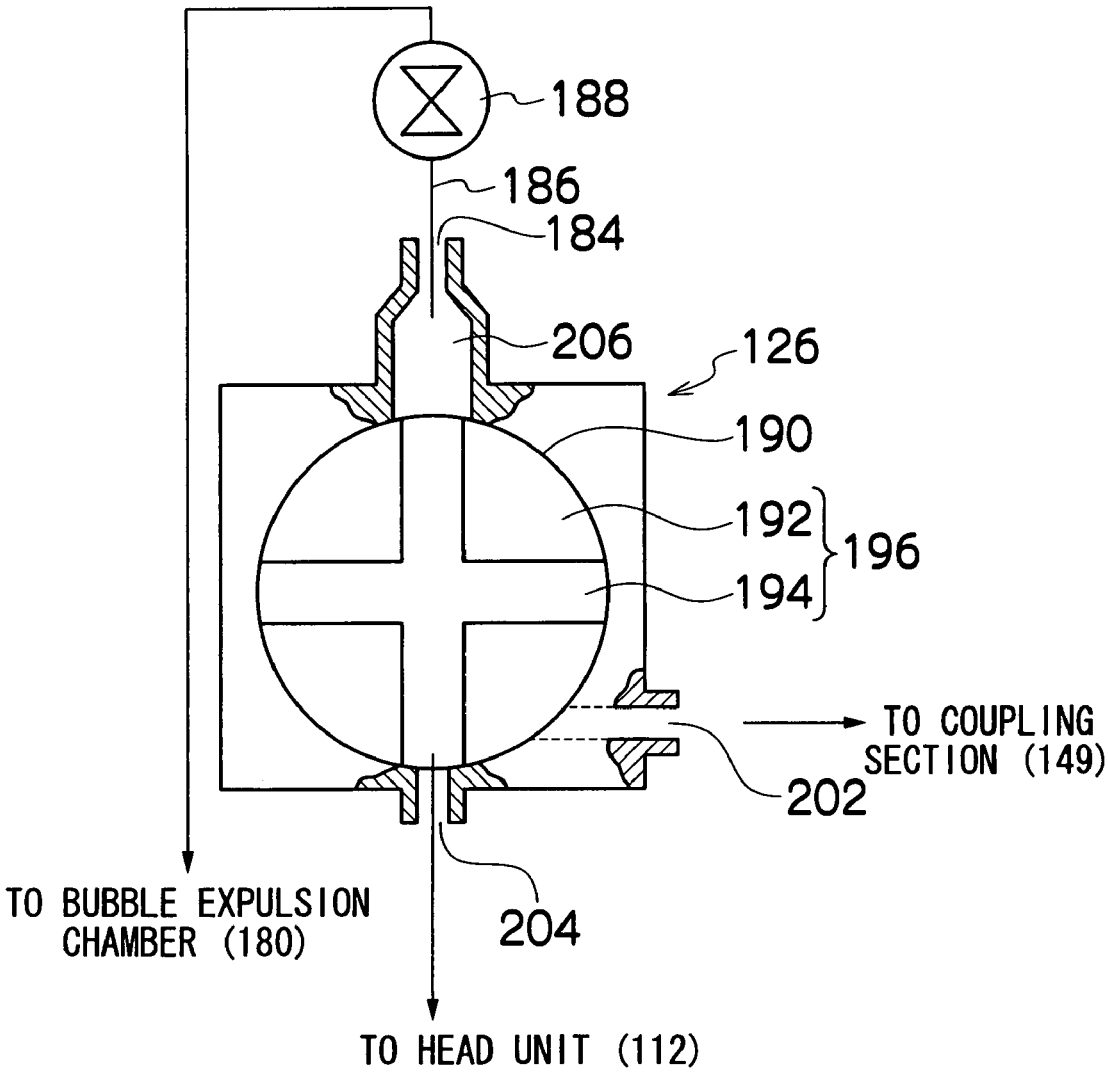
FIG. 16 is a diagram showing the composition of a negative pressure maintaining unit which is installed on the head unit.

Next, the structure of a negative pressure maintaining unit 126 is described below. FIG. 16 is a side view diagram showing a schematic view of the composition of a negative pressure maintaining unit 126 (a diagram observed in the direction of arrow A in FIG. 15).

As shown in FIG. 16, the negative pressure maintaining unit 126 comprises a sub tank 190 having an ink accommodation capacity for temporarily storing ink supplied to the head unit 112, and the surface (side face) of one portion of the sub tank 190 is constituted by an elastic deformation member 196 comprising a plastic film 192 and a leaf spring 194.

In other words, the sub tank 190 has a structure of which at least a portion deforms elastically when the internal pressure is lower than the atmospheric pressure, and hence a negative pressure is created when the volume of the sub tank 190 is contracted. Furthermore, when the internal pressure of the sub tank 190 has reached atmospheric pressure, then the volume is restored to its original value by the restoring force created by the elastic deformation.

The negative pressure maintaining unit 126 according to the present example has a structure in which a circular plastic film 192 is formed in one wall of the container of a sub tank 190 made of a material having sufficient rigidity to maintain its external shape, a cross-shaped leaf spring 194 being fixed to this plastic film 192, in such a manner that the plastic film 192 is displaced by change in the internal pressure.

When the internal pressure of the sub tank 190 is at atmospheric pressure, then a deforming force does not act on the leaf spring 194, but when the internal pressure becomes a negative pressure, then the plastic film 192 and the leaf spring 194 deform in a direction which reduces the volume of the sub tank 190, in such a manner that a negative pressure is generated inside the sub tank 190.

If the elastic deformation member 196 constituted by the plastic film 192 and the leaf spring 194 is displaced in a direction which reduces the volume of the sub tank 190, then due to the elastic force (restoring force) of the leaf spring 194, a force is exerted in a direction which expands the internal volume of the sub tank 190 (in other words, the internal volume of the negative pressure maintaining unit 126). Due to the action of this elastic deformation member 196, the internal pressure of the sub tank 190 is maintained at a negative pressure. The shape (coefficient of elasticity) of the leaf spring 194 is set appropriately on the basis of the amount of deformation of the elastically deformable member 196 and the force to be generated when it is deformed.

In the mode shown in FIG. 16, a composition is depicted in which an elastic deformation member 196 comprising a plastic film 192 and a leaf spring 194 whose surfaces are bonded (welded) together is provided in at least one wall surface of the sub tank 190, but apart from the composition described above, the elastic deformation member 196 may also be composed by arranging a leaf spring and a plastic film together in a sandwich configuration and then welding same together.

An ink supply port 202 which connects with the coupling section 149 shown in FIG. 15 and a head connection port 204 forming a connection port with the head unit 112 are provided in the negative pressure maintaining unit 126. As described in FIG. 13 and FIG. 14, by coupling the coupling sections 149 with the ink supply coupling sections 148 of the sub cartridge 140, the ink cartridge 114 is connected with the sub tank 190 in FIG. 16, and therefore ink is supplied to the sub tank 190 via the ink supply port 202.

Furthermore, the head connection port 204 which is a port for connecting to the head unit 112 is provided in the lower face of each negative pressure maintaining unit 126 (the bottom face portion of the sub tank 190), and ink is supplied to the head from the sub tank 190 via this head connection port 204.

A bubble collecting section 206 is formed in the upper portion of the sub tank 190. The bubble collecting section 206 has a smooth curved surface shape in which the cross-section of the flow channel gradually becomes smaller toward the upper side (for example, a tapered shape narrowing towards the tip), and air bubbles which have flowed into the sub tank 190 from the head unit 112 move upwards due to their force of buoyancy, and the bubbles are guided into the bubble collecting section 206 and accumulate in the upper portion of the bubble collecting section 206, without becoming trapped during their travel. The shape of the inner surface of the bubble collecting section 206 is not limited to that described above, and for example, instead of a tapered shape (a conical surface shape), it may also be a hemispherical shape, or the like.

The expulsion port 184 provided in the uppermost portion of the bubble collecting section 206 is connected to the bubble expulsion flow channel 186. As illustrated in FIG. 15, a non-reversing valve 188 (or an opening and closing valve) is provided in the bubble expulsion flow channel 186, and furthermore, the end of the bubble expulsion flow channel 186 on the side opposite to the expulsion port 184 (bubble expulsion port) is connected to the bubble expulsion chamber 180 (see FIG. 15).

By adopting the negative pressure maintaining unit 126 having the composition described above, as shown in FIG. 17, the plastic film 192 is displaced in accordance with the amount of ink inside the sub tank 190, and the internal pressure of the negative pressure maintaining unit 126 also changes accordingly.

Figure 17:
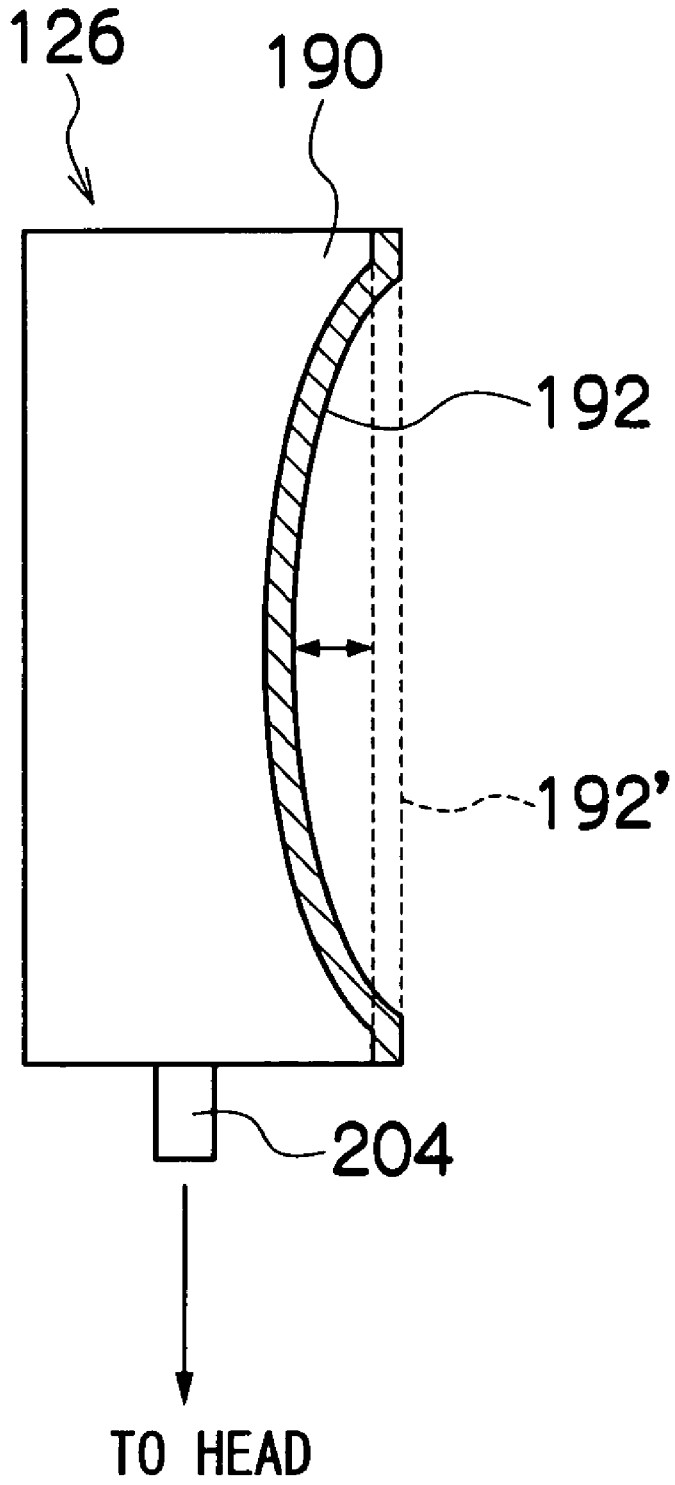
FIG. 17 is a diagram for describing the volume displacement of a sub tank.

In FIG. 17, the plastic film 192' indicated by the dotted line indicates a state where sufficient ink has been filled (namely, an initial state immediately after the completion of ink supply by means of a pit stop in the home position), and the plastic film 192 indicated by the solid line indicates a state where the ink inside the sub tank 190 has been reduced due to consumption of the ink by the print head and the internal pressure of the negative pressure maintaining unit 126 (the absolute value of the negative pressure) has risen and replenishment of ink has become necessary.

Since there is a correlation between the amount of change in the plastic film 192 and the amount of change in the internal pressure of the negative pressure maintaining unit 126 (in other words, the amount of change in the volume of the sub tank 190), then it is possible to determine the internal pressure of the negative pressure maintaining unit 126 indirectly by measuring (determining) the amount of change in the plastic film 192.

Figure 18A:
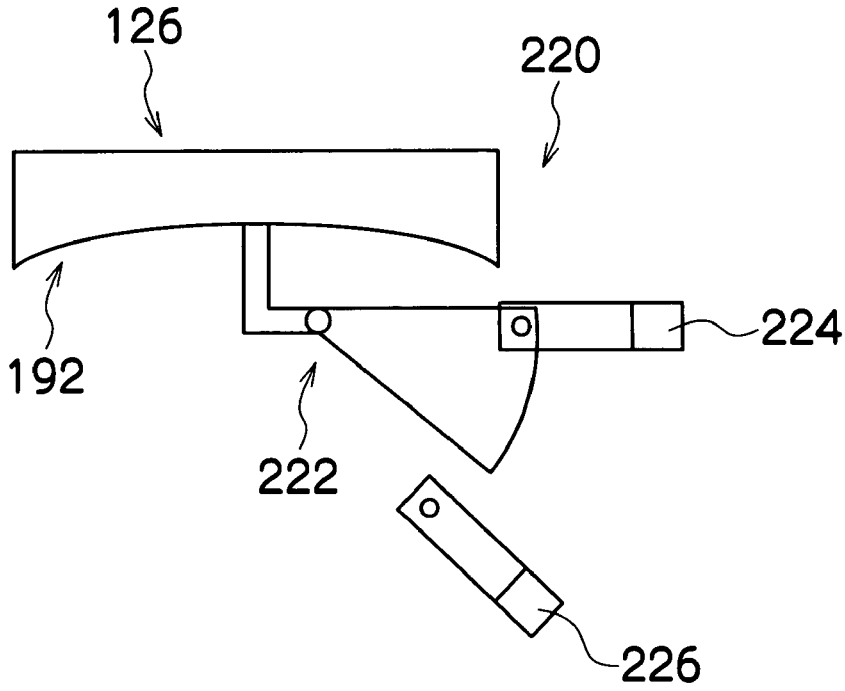
FIGS. 18A and 18B are illustrative diagrams showing one example of a device which determines the internal pressure of the negative pressure maintaining unit.
Figure 18B:
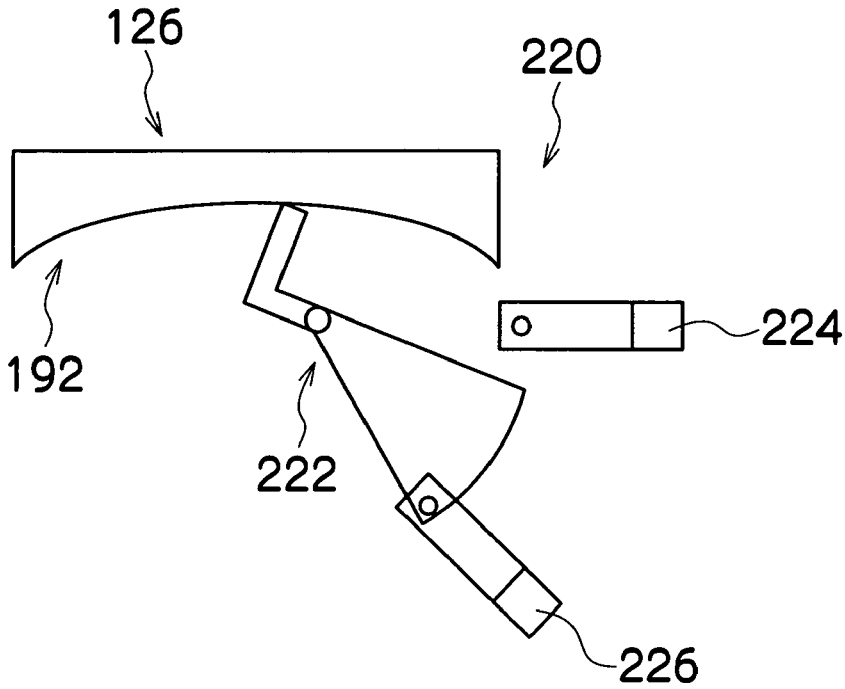

One example of the device for measuring the internal pressure of the negative pressure maintaining unit 126 is illustrated below with reference to FIGS. 18A and 18B. FIGS. 18A and 18B show an example of the composition of a determination mechanism 220 which determines the amount of deformation of the plastic film 192 (an internal pressure determination unit for the negative pressure maintaining unit 126). The determination mechanism 220 shown in FIGS. 18A and 18B comprises an actuator 222 which rotates in accordance with the amount of deformation of the plastic film 192, and two optical sensors 224 and 226.

The first sensor 224 is disposed in a position corresponding to the initial state of the plastic film 192, and it determines the internal pressure corresponding to the hydraulic head pressure differential (the initial refill pressure of the sub tank) between the height of the nozzle surface of the head unit 112 and the position (height) of the ink cartridge 114 in a state where the negative pressure maintaining unit 126 is coupled to the sub cartridge 140.

The second sensor 226 determines the upper pressure limit of the internal pressure (negative pressure) in the negative pressure maintaining unit 126 during the execution of a printing operation (in other words, the internal pressure corresponding to the remaining ink level at which ink supply by means of a pit stop is necessary).

FIG. 18A shows a state where the negative pressure maintaining unit 126 is coupled to the sub cartridge 140 and ink has been filled into the negative pressure maintaining unit 126; the internal pressure of the negative pressure maintaining unit 126 determined in this state (the initial refill pressure upon the completion of filling) is −10 mm $H_2O$, for example.

Furthermore, FIG. 18B shows the upper limit state of the internal pressure in the negative pressure maintaining unit 126 while carrying out printing (a state where ink replenishment is required), and the internal pressure of the negative pressure maintaining unit 126 determined in this state is −70 mm $H_2O$, for example.

It is also possible to use a strain gauge (a distortion determination member) instead of the actuators 222 shown in FIGS. 18A and 18B. Furthermore, FIGS. 18A and 18B show a mode where two optical sensors are provided, but of these two sensors, it is possible to omit the first sensor 224, provided that there is at least a sensor (e.g., the sensor 226 in FIGS. 18A and 18B) which can determine whether the amount of deformation of the plastic film 192 (the amount of change in the volume of the sub tank 190) is equal to or greater than a prescribed amount.

Example of Structure of Ink Supply Coupling Section

Figure 19A:
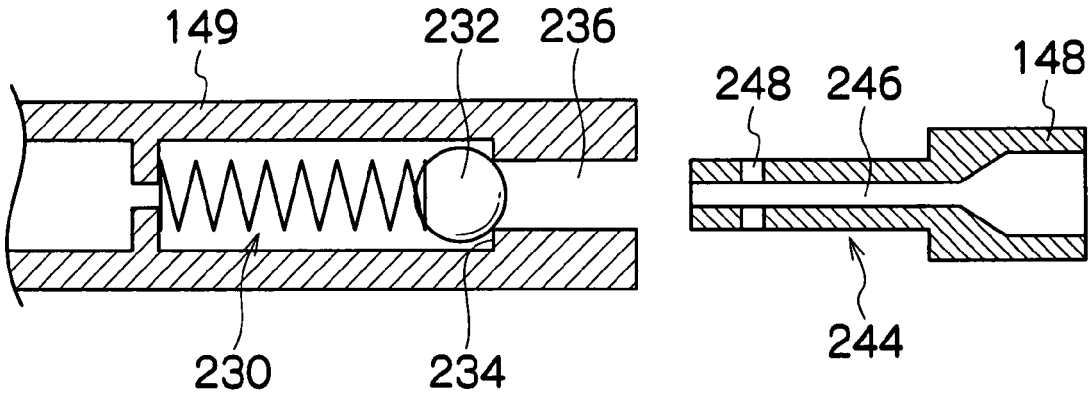
FIGS. 19A and 19B are cross-sectional diagrams showing an example of the structure of an ink supply coupling unit of the sub cartridge and a coupling section for ink supply on the side of head unit.
Figure 19B:
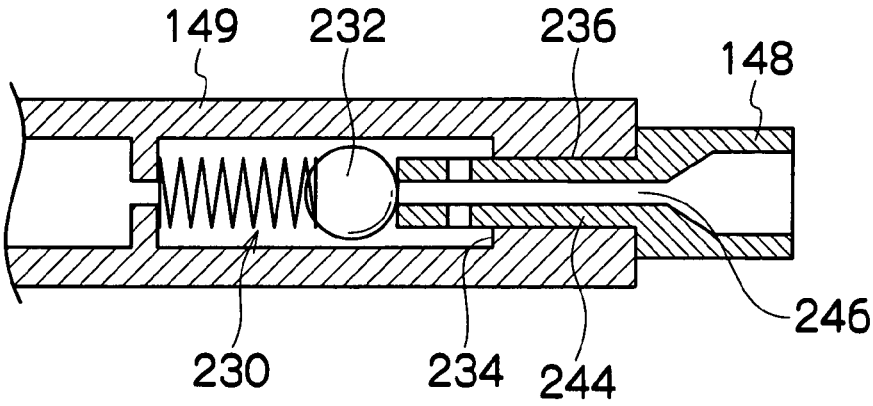

FIGS. 19A and 19B are cross-sectional diagrams showing an example of the structure of an ink supply coupling section 148 which is provided in the sub cartridge 140 and a coupling section 149 for ink supply which is provided on a side of the negative pressure maintaining unit 126 of the head unit 112.

FIG. 19A shows a state where the coupling section 149 on the side of the negative pressure maintaining unit 126 is detached from the ink supply coupling section 148 of the sub cartridge 140, and FIG. 19B shows a state where these two sections are coupled together.

As shown in FIG. 19A, the interior of the coupling section 149 on the negative pressure maintaining unit 126 has the structure of a non-reversing valve, in which a ball (valve body) 232 is impelled in the opposite direction to the inflow direction of the ink (namely, in the rightward direction in FIG. 19A) by means of the force of an elastic member (for example, a spring) 230, thereby causing the ball 232 to press up against the end face (valve seating) 234 of the flow channel having a small diameter and thus sealing off the ink flow path.

On the other hand, the ink supply coupling section 148 on the sub cartridge 140 which fits into this coupling section 149 has an ink supply needle 244 that can be inserted into an insertion aperture 236 of the coupling section 149, and an opening hole 248 which connects with an internal flow channel 246 of the ink supply needle 244 is formed in the circumferential surface of the ink supply needle 244, in a position near the tip of the needle.

In the separated state shown in FIG. 19A, the flow channel of the insertion aperture 236 is closed off by the ball 232 which is impelled by the elastic member (for example, the spring) 230, and hence the valve assumes a closed state.

In the coupled state shown in FIG. 19B, by inserting the ink supply needle 244 into the insertion aperture 236, the ball 232 is pushed and moved in the opposite direction of the direction of impulsion of the elastic member 230, by the front tip of the ink supply needle 244, and therefore ink flows into the coupling section 149 via the opening hole 248 in the ink supply needle 244. In other words, in the coupled state shown in FIG. 19B, the valve including the ball 232 assumes an open state, and hence the head unit 112 and the ink cartridge 114 shown in FIG. 12 assume a mutually connected state.

Example of Valve Structure Used in Bubble Expulsion Channel

Figure 20A:
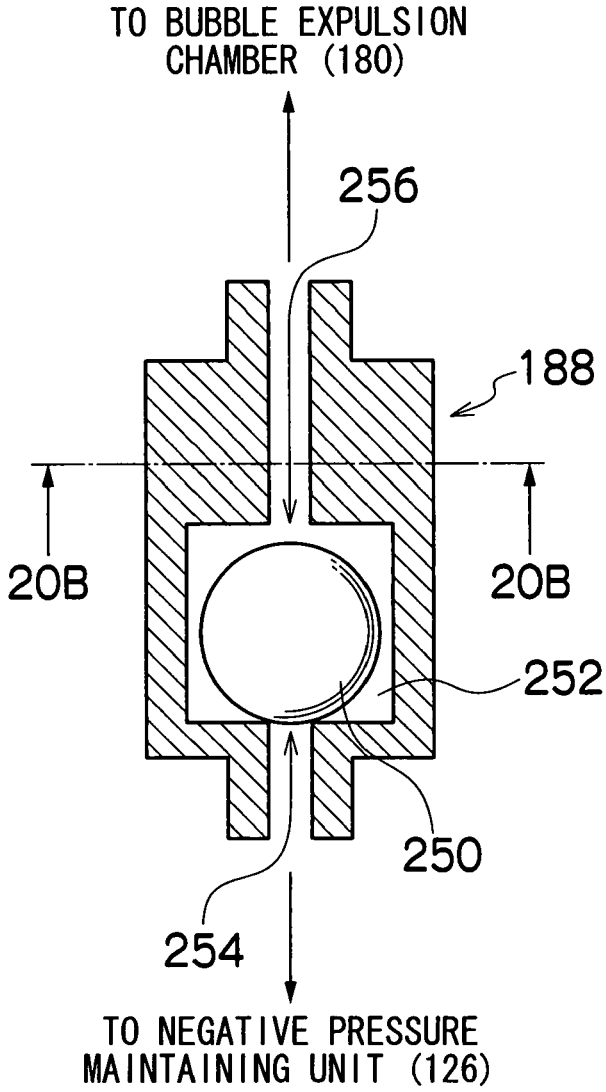
FIGS. 20A and 20B are cross-sectional diagrams illustrating the structure of a non-reversing valve which is connected to the bubble expulsion aperture shown in FIG. 16.
Figure 20B:
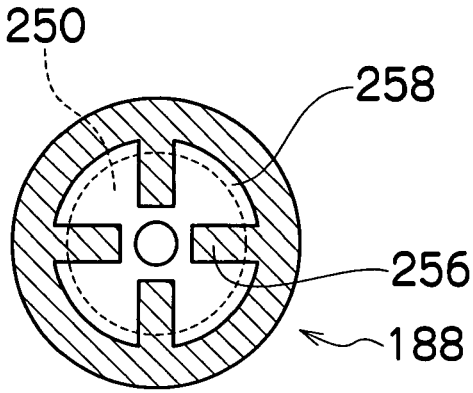

FIGS. 20A and 20B show an example of the structure of the non-reversing valve 188 shown in FIG. 16. FIG. 20B is a cross-sectional diagram taken along line 20B-20B in FIG. 20A. As shown in FIG. 20A, the non-reversing valve 188 has a structure in which: a substantially spherical ball (valve body) 250 is inserted idly into a flow channel 252; an aperture 254 having a flow channel cross-sectional area of a size which can be sealed by the ball 250 is formed in the flow channel 252 accommodating the ball 250, on the side which connects to the negative pressure maintaining unit 126 (the lower side in FIG. 20A); and an aperture 258 which formed by projection-shaped portions 256 provided on the inner side of a substantially circular shape which is larger than the diameter of the ball 250 (namely, an opening creating a flow channel having a cross-sectional shape whereby the flow channel is not sealed off even if the ball 250 abuts against the opening) is provided on the side which connects to the bubble expulsion chamber 180 (the upper side in FIG. 20A).

Consequently, in a state where the suction pump on the side of the bubble expulsion chamber 180 (indicated by reference numeral 288 in FIG. 21) applies a suctioning force, the ball 250 abuts against the end face of the aperture 258 (namely, against the projection-shaped portions 256), thereby opening the aperture 254 on the side near to the negative pressure maintaining unit 126, and the bubbles are expelled via the gap between the ball 250 and the aperture 254 (namely, the non-reversing valve 188 is opened by a pressure acting in the forward direction).

On the other hand, in a state where the suction pump (indicated by reference numeral 288 in FIG. 21) on the side of the bubble expulsion chamber 180 has been halted (a state where the bubble expulsion chamber 180 is not being suctioned), the ball 250 makes contact with the aperture 254 on the side of the negative pressure maintaining unit 126 and thereby seals off the aperture 254 (the valve is closed due to a pressure acting in the reverse direction). The valve structure shown in FIGS. 20A and 20B only represent one example, and it is possible to adopt other valve structures.

Example of Composition of Restoration Unit

Figure 21:
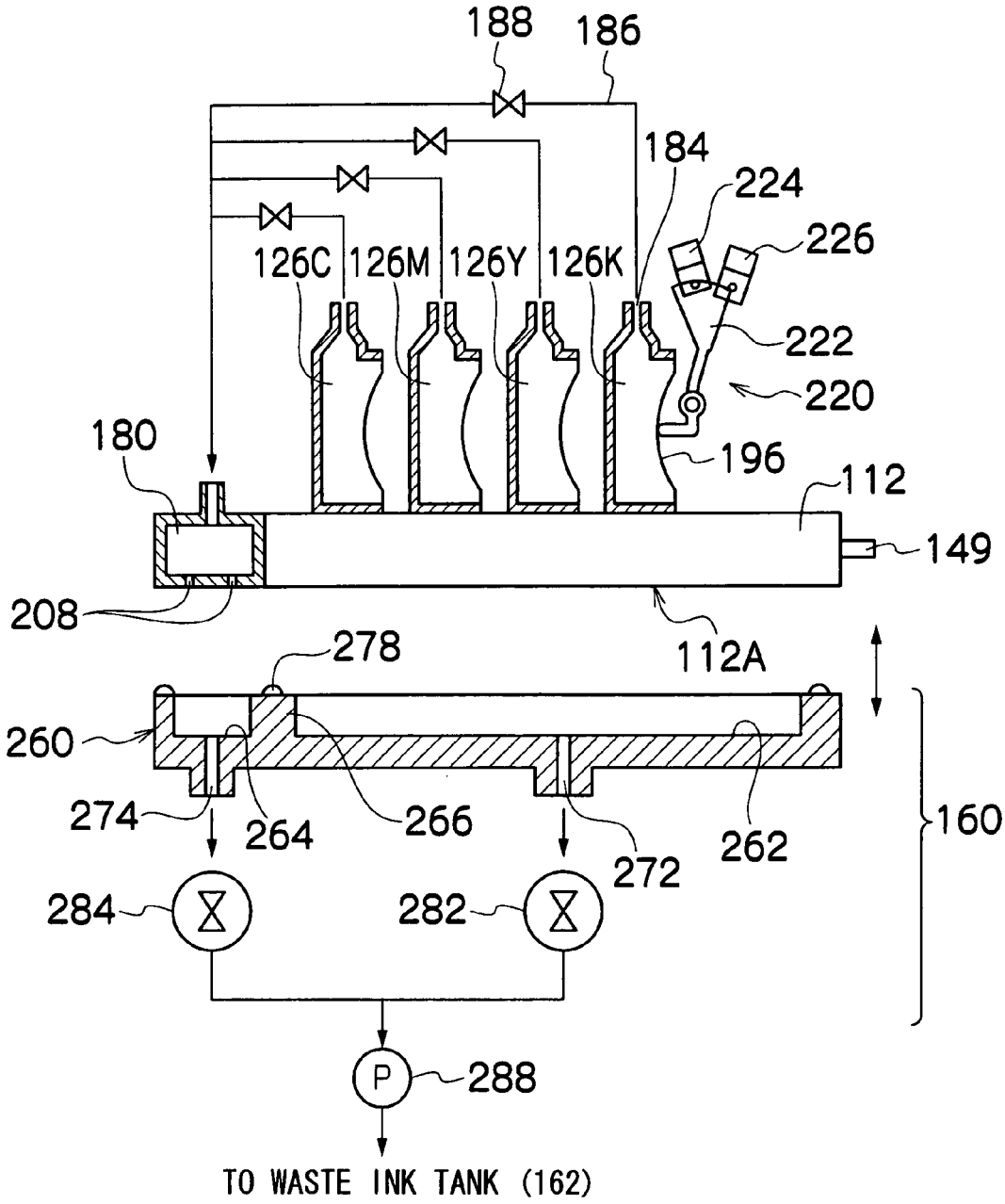
FIG. 21 is a schematic drawing showing the general composition of the head unit and the restoration unit.

FIG. 21 is a schematic drawing showing the approximate composition of the head unit 112 and the restoration unit 160. FIG. 21 shows the head unit 112 as viewed from the front surface (in the direction of arrow B in FIG. 15), and in order to simplify the description, it includes a partial transparent section. In FIG. 21, in order to simplify the illustration, the determination mechanism 220 is depicted only in relation to the negative pressure generating unit 126K for K ink, but in fact similar determination mechanisms 220 are provided respectively for the negative pressure maintaining units 126C, 126M, 126Y and 126K.

As shown in FIG. 21, the restoration unit 160 comprises a cap 260 which presses against the nozzle surface (ink ejection surface) 112A of the head unit 112 and the lower surface of the bubble expulsion chamber 180 (the surface in which the bubble expulsion holes 208 are formed).

The cap 260 has structure in which a first cap section (nozzle suctioning cap section) 262 which covers the nozzle forming region of the nozzle surface 112A, and a second cap section (chamber suctioning cap section) 264 which covers the region of the bubble expulsion chamber 180 including the bubble expulsion holes 208 are combined integrally via a separating partition 266. The expulsion ports 272 and 274 of the first cap section 262 and the second cap section 264 are connected via independent valves 282 and 284 respectively, to a common suction pump 288. The suction pump 288 is connected to the waste ink tank 162 shown in FIG. 13.

The valve 282 which connects to the first cap section 262 shown in FIG. 21 is called the "first valve 282", and the valve 284 which connects to the second cap section 264 is called the "second valve 284".

The cap 260 is supported on an elevator drive mechanism (not illustrated), and is movable between a withdrawn position where it is distant from the nozzle surface 112A and a capping position where it presses against the nozzle surface 112A. The nozzle surface 112A and the lower surface of the bubble expulsion chamber 180 lie in the same plane, and an elastic member (sealing member) 278 for increasing the adhesion (hermetic sealing properties) created upon pressurized contact is provided on the portion of the cap 260 which makes contact with the nozzle surface 112A and the lower surface of the bubble expulsion chamber 180.

According to the composition described above, by operating the elevator drive mechanism (not illustrated) to place the first cap section 262 in tight contact with the nozzle surface 112A of the head unit 112, placing the second cap section 264 in tight contact with the bubble expulsion hole 208 forming surface of the bubble expulsion chamber 180, opening the first valve 282 and the second valve 284, and then operating the suction pump 282, the ink inside the head unit 112 and the negative pressure maintaining units 126 can be suctioned and the bubbles inside the head and the negative pressure maintaining units 126 can be expelled to the exterior. Furthermore, upon initial filling of ink into the head unit 112 as well, the cap 260 is placed against the nozzle surface 112A and the bubble expulsion chamber 180, and the suction pump 288 is operated while controlling the valves 282 and 284.

In the present example, one cap member (cap 260) having the first cap section 262 and the second cap section 264 is used, but a mode is also possible in which a cap for suctioning the nozzles, which corresponds to the first cap section 262, and a cap for suctioning the chamber, which corresponds to the second cap section 264, are respectively constituted by separate cap members, and individual elevator drive mechanisms are provided respectively for the cap members.

Description of Control System

Figure 22:
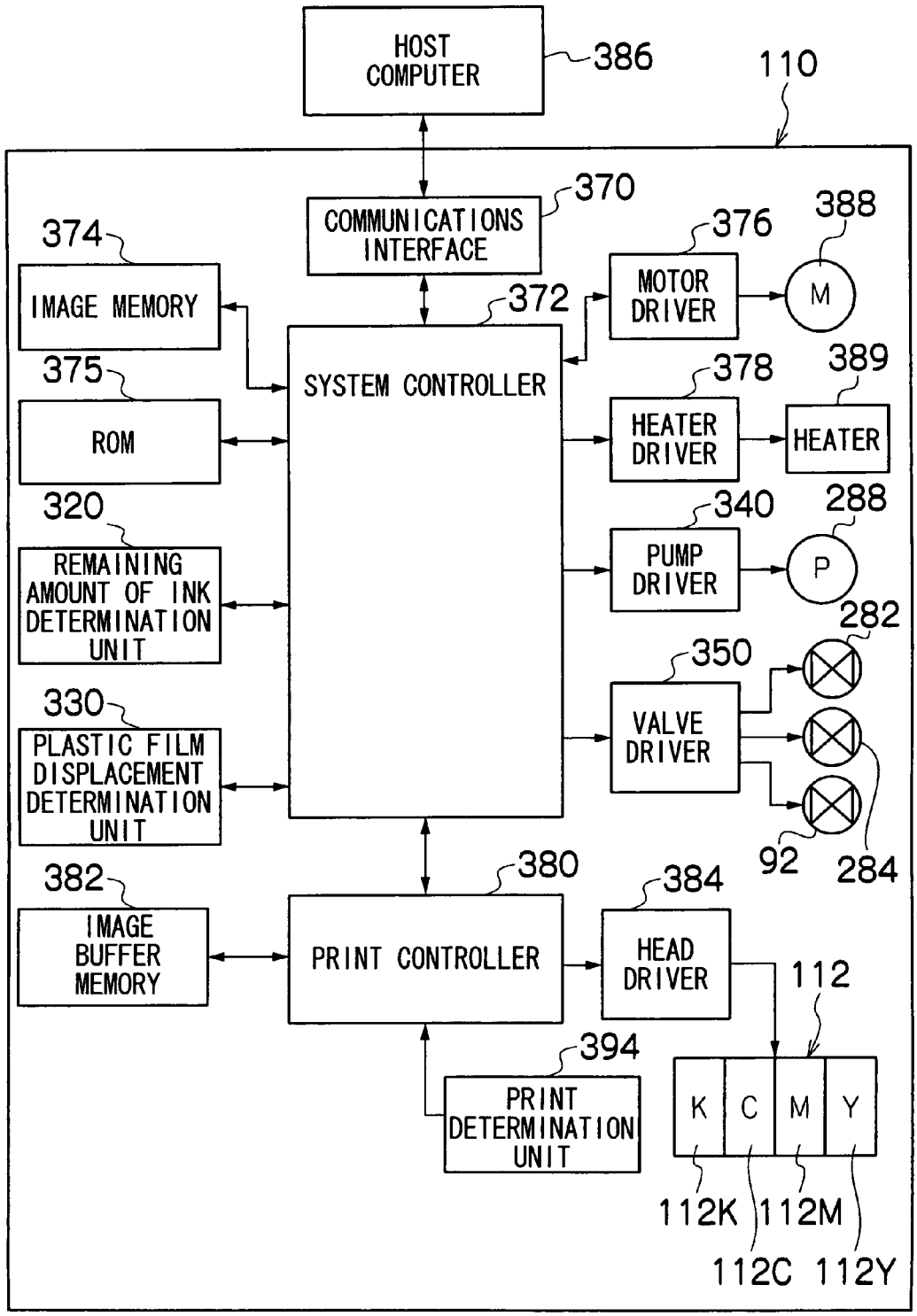
FIG. 22 is a block diagram showing the composition of a control system in an inkjet recording apparatus according to an embodiment of the present embodiment.

FIG. 22 is a block diagram showing a system composition of the control system of the inkjet recording apparatus 110. The inkjet recording apparatus 110 according to the present example comprises a remaining amount of ink determination unit 320 for determining the remaining amount of ink in the ink cartridges 114 (see FIG. 12), a plastic film displacement determination unit 330 for determining the displacement of the plastic film 192 of the negative pressure maintaining unit 126, a pump driver 340 for driving the suction pump 288 of the restoration unit 160 (see FIG. 13 and FIG. 21), and a valve driver 350 for controlling the first valve 282, the second valve 284 and the air connection valves 92.

Furthermore, as shown in FIG. 22, the inkjet recording apparatus 110 comprises a communications interface 370, a system controller 372, an image memory 374, ROM 375, a motor driver 376, a heater driver 378, a print controller 380, an image buffer memory 382, a head driver 384, and the like.

The remaining amount of ink determination unit 320 comprises the light-emitting elements 20 and 22 and the photoreceptor elements 24 and 26 described in relation to FIG. 2, as well as an optical sensor (reference numeral 404 in FIG. 24), described hereinafter, which determines the remaining amount of ink in the ink supply channel (reference numeral 401 in FIG. 24).

The remaining amount of ink information relating to the ink cartridges 114 obtained by the remaining amount of ink determination unit 320 is displayed by means of a prescribed display device, such as a monitor of a host computer 386, or the like, and furthermore, an appropriate warning is issued by a warning device if the remaining amount of ink in an ink cartridge 114 has become low, thereby prompting replacement of the ink cartridge 114.

The plastic film displacement determination unit 330 corresponds to the determination mechanism 220 shown in FIG. 18. In other words, the plastic film displacement determination unit 330 shown in FIG. 22 includes optical sensors 224 and 226 arranged so as to determine the displacement of the plastic film 192 in each of the negative pressure maintaining units 126 of the respective colors.

The displacement information obtained from the plastic film displacement determination unit 330 is information which reflects the remaining amount of ink inside each of the negative pressure maintaining units 126 and the internal pressure (negative pressure value) inside same, and if it is determined on the basis of this information that the remaining amount of ink inside each negative pressure maintaining unit 126 has become lower than a prescribed amount (in other words, if the internal pressure of the negative pressure maintaining unit 126 has become a negative pressure that is larger than a prescribed value), an operation for replenishing ink into the negative pressure maintaining unit 126 by means of the pit stop is carried out.

The pump driver 340 is a control block which controls the on and off switching and the drive direction of the suction pump 288, in accordance with instructions from the system controller 372.

The valve driver 350 is a control block which opens and closes the valves 282 and 284 of the restoration unit 160 described in relation to FIG. 21, and the air connection valves 92 (92C, 92M, 92Y and 92K) described in relation to FIG. 11, in accordance with instructions from the system controller 372.

The communications interface 370 is an interface unit for receiving image data transmitted by the host computer 386. For the communications interface 370, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications.

Image data sent from the host computer 386 is read into the inkjet recording apparatus 110 via the communications interface 370, and it is stored temporarily in the image memory 374. The image memory 374 is a storage device for temporarily storing an image input via the communications interface 370, and data is written to and read from the image memory 374 via the system controller 372. The image memory 374 is not limited to a memory comprising a semiconductor element, and a magnetic medium, such as a hard disk, or the like, may also be used.

The system controller 372 is a control device for controlling the various sections, such as the communications interface 370, the image memory 374, the pump driver 340, the valve driver 350, the motor driver 376, the heater driver 378, and the like. The system controller 372 is constituted by a central processing unit (CPU) and peripheral circuits thereof, and the like, and in addition to controlling communications with the host computer 386 and controlling reading and writing from and to the image memory 374, and the like, it also generates control signals for controlling the motor 388 of the conveyance system and the heater 389.

The program executed by the CPU of the system controller 372 and the various types of data which are required for control procedures are stored in the ROM 375. The ROM 375 may be a non-rewritable storage device, or it may be a rewritable storage device, such as an EEPROM. The image memory 374 is used as a temporary storage region for the image data, and it is also used as a program development region and a calculation work region for the CPU.

The motor driver 376 is a driver (drive circuit) which drives the motor 388 in accordance with instructions from the system controller 372. FIG. 22 shows one motor driver 376 and motor 388, but the inkjet recording apparatus 110 actually comprises a plurality of motors and motor drivers for driving these. To give one example, there is a motor which drives the paper supply roller 130 shown in FIG. 12, a motor which operates the carriage 124, a motor which drives the conveyance rollers 134 and 136 provided in the conveyance path of the recording paper 116, and the like. The system controller 372 shown in FIG. 22 controls the plurality of motor drivers corresponding to this plurality of motors.

Furthermore, the same applies to the heater driver 378 and the heater 389, and the inkjet recording apparatus 110 in fact comprises a plurality of heaters and heater drivers for driving these heaters. The system controller 372 controls the plurality of heaters and heater drivers provided in the apparatus.

The print controller 380 is a control unit which functions as a signal processing device for performing various treatment processes, corrections, and the like, in accordance with the control implemented by the system controller 372, in order to generate a signal for controlling ink ejection (print data), from the image data (multiple-value input image data) in the image memory 374, and it supplies the print control signal (print data) thus generated to the head driver 384.

Required signal processing is carried out in the print controller 380, and the ejection amount and the ejection timing of the ink droplets from the print head 112C, 112M, 112Y and 112K of the respective colors are controlled via the head driver 384, on the basis of the image data. By this means, desired dot sizes and dot positions can be achieved.

An image buffer memory 382 is formed with the print controller 380, and image data, parameters, and other data are temporarily stored in the image buffer memory 382 when image data is processed in the print controller 380. FIG. 22 shows a mode in which the image buffer memory 382 is attached to the print controller 380; however, the image memory 374 may also serve as the image buffer memory 382. Moreover, a mode is also possible in which the print controller 380 and the system controller 372 are integrated and constituted by a single processor.

The head driver 384 drives the pressurization devices 108 (see FIG. 10) provided in the print heads 112C, 112M, 112Y and 112K of the respective colors, on the basis of the print data supplied from the print controller 380. A feedback control system for maintaining constant drive conditions for the heads may be included in the head driver 384.

To give a general description of the sequence of processing from image input to print output, image data to be printed (original image data) is input from an external source via the communications interface 370, and is accumulated in the image memory 374. At this stage, multiple-value RGB input image data is stored in the image memory 374, for example.

In this inkjet recording apparatus 110, an image which appears to have continuous tonal graduations to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 374 is sent to the print controller 380 through the system controller 372, and is converted to the dot data (droplet ejection arrangement data) for each ink color by a halftoning technique, using dithering, error diffusion, or the like.

In other words, the print controller 380 performs processing for converting the input RGB image data into dot data for the four colors of K, C, M and Y. The dot data generated by the print controller 380 in this way is stored in the image buffer memory 382. This dot data according to colors is converted into CMYK droplet ejection data for ejecting ink from the nozzles 101 of the print heads 12C, 12M, 12Y and 12K of the respective colors, thereby establishing the ink ejection data to be printed.

The head driver 384 outputs drive signals for driving the pressurization elements 108 corresponding to the nozzles 101 of the respective print heads 112C, 112M, 112Y and 112K, on the basis of the ink ejection data supplied by the print controller 380.

By controlling ejection of ink from the print heads 112C, 112M, 112Y and 112K in synchronism with the conveyance speed of the recording paper 116 forming a recording medium and the scanning speed of the head unit 112, an image is formed on the recording paper 116.

Furthermore, the inkjet recording apparatus 110 according to the present example comprises a print determination unit 394 to serve as a device for determining the print results of the head unit 112. The print determination unit 394 is a block including an image sensor (for example, a CCD imaging element or a CMOS imaging element), and it functions as a device for checking for blockages of the nozzles 101, and other ejection abnormalities, on the basis of the results read in by the image sensor.

In other words, the print determination unit 394 reads in the image printed onto the recording medium 116, performs various signal processing operations, and the like, and determines the print situation (presence/absence of ejection, depositing position error, dot shape, optical density, and the like), these determination results being supplied to the print controller 380 and the system controller 372.

Next, the operation of the inkjet recording apparatus 110 having the foregoing composition is described below.

Initial Ink Filling Operation

During initial filling of ink into a print head which has not been filled with ink, or during initial filling of ink after replacement of an ink cartridge, the initial refilling process described below is carried out.

Firstly, ink cartridges 114 are installed in the main body of the apparatus (in the sub cartridge 140), the head unit 112 is moved to the home position by scanning (moving) the carriage 124, and the coupling sections 149 on the side of the head unit 112 are coupled with the ink supply coupling sections 148 in the sub cartridge 140.

Thereupon, the cap 260 of the restoration unit 160 is raised upwards, and the cap 260 is pressed against the nozzle surface 112A and the bubble expulsion chamber 180 (see FIG. 21). In other words, the nozzle forming region of the head unit 112 is covered by the first cap section 262, and the bubble expulsion hole 208 forming region of the bubble expulsion chamber 180 is covered by the second cap section 264.

Thereupon, the first valve 282 connected to the first cap section 262 is closed, the second valve 284 connected to the second cap section 264 is opened, a negative pressure is applied by the suction pump 288, and the non-reversing valve 188 in the bubble expulsion flow channel 186 is opened, thereby filling ink into the negative pressure maintaining unit 126 (in other words, into the sub tank 190).

In this way, during initial filling of the ink, the liquid inside each sub tank 190 is expelled reliably from the bubble expulsion flow channel 186 via the expulsion port 184 in the negative pressure maintaining unit 126 (sub tank 190), in a state where the second valve 284 is open and the first valve 282 is closed, and therefore it is possible to replace the contents of the sub tank 190 with ink.

When refilling of ink into the negative pressure maintaining unit 126 (more specifically, sub tank 190) has finished, the second valve 284 is closed, the first valve 282 is opened, and a negative pressure is applied by the suction pump 288, thereby refilling ink into the head.

When the suction pump 288 is halted after filling with ink, the leaf spring 194 in each of the negative pressure maintaining units 126 is displaced in accordance with the hydraulic head pressure differential between the position (height) of the ink cartridge 114 and the height of the nozzle surface, thereby maintaining the internal pressure.

Thereupon, when the coupling sections 149 of the head unit 112 are separated from the ink supply coupling sections 148 of the sub cartridge 140, the ink supply valves in the negative pressure maintaining units 126 (the non-reversing valves based on the ball 232 illustrated in FIGS. 19A and 19B) close and the negative pressure maintaining units 126 are maintained at a negative internal pressure by the leaf springs 194.

Ink Supply Control (Pit Stop) During Printing

During printing, the ink inside the negative pressure maintaining units 126 is consumed due to the ejection of ink, and therefore the ink inside the negative pressure maintaining units 126 declines, the displacement of the leaf springs 194 increases and the negative pressure rises. As shown in FIG. 18B, when the upper limit of the negative pressure is determined, the head unit 112 is moved to the home position and ink replenishment is carried out by means of the pit stop operation. When a negative pressure maintaining unit 126 and the corresponding ink supply coupling section 148 have been coupled in the pit stop operation, ink is supplied naturally from the ink cartridge 114 into the negative pressure maintaining unit 126 (without requiring the application of pressure, such as a positive pressure from the supply side, or a suctioning pressure from the receiving side) since the interior of the negative pressure maintaining unit 126 has a greater negative pressure than the pressure inside the ink supply coupling section 148.

In other words, when the negative pressure maintaining unit 126 and the ink supply coupling section 148 are coupled together, the internal pressure of the head at the nozzle surface is restored to a negative pressure which corresponds to the height of the hydraulic head between the ink cartridge 114 and the nozzle surface 112A. In this case, ink is supplied from the ink cartridge 114 to the negative pressure maintaining unit 126 until the leaf spring 194 of the negative pressure maintaining unit 126 is displaced and restored to its previous position.

Figure 23:
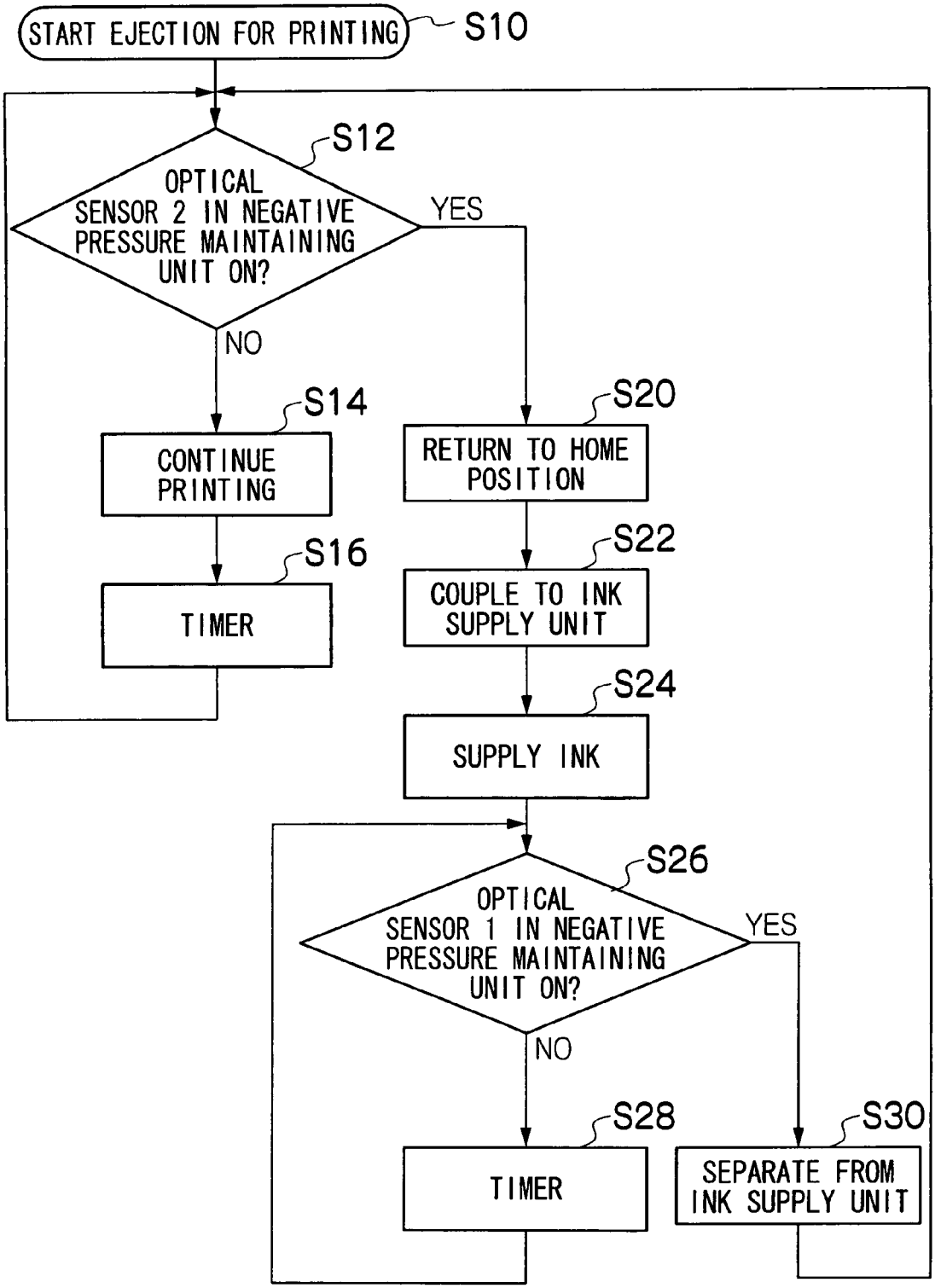
FIG. 23 is a flowchart of an ink supply control procedure during a printing operation.

FIG. 23 shows a flowchart of an ink supply control procedure during a printing operation. As shown in FIG. 23, when a printing operation is carried out (step S10), at step S12 the switching on of the second sensor 226 for determining a displacement amount of the plastic film 192 in the negative pressure maintaining unit 126 is monitored. If it is judged that the second sensor 226 is off (NO verdict at step S12), then the printing operation continues (step S14), the time period since scanning of the second sensor 226 is measured by using a timer (step S16), and the second sensor 226 is monitored each time that a prescribed time period has elapsed, to check whether it has switched on.

On the other hand, if it is judged at step S12 that the second sensor 226 is on (YES verdict), printing is suspended and then the head 112 is moved to the home position (step S20).

When the head 112 is moved to the home position, the coupling section 149 which connects to the negative pressure maintaining unit 126 couples with the ink supply coupling unit 148 in the sub cartridge 140 (step S22), and ink is supplied to the sub tank 190 of the negative pressure maintaining unit 126, from the ink cartridge 114 (step S24).

During the supply of ink in step S24, the first sensor 224 is monitored to check if it switches on (step S26). If the first sensor 224 is off, then the time from the previous scan of the first sensor 224 is counted by using a timer (step S28), and the first sensor 224 is then monitored to check if it has switched on, at prescribed time intervals.

On the other hand, if it is judged at step S26 that the first sensor 224 is on (YES verdict), then the ink supply coupling section 149 which connects to the negative pressure maintaining unit 126 is separated from the ink supply coupling unit 148 of the sub cartridge 140 (step S30), and the ink supply control procedure transfers to step S12.

As described above, according to the present embodiment, in a state where a negative pressure maintaining unit 126 is coupled to an ink supply coupling section 148 of the sub cartridge 140 by means of a pit stop operation, a suitable negative pressure is generated inside the head due to the hydraulic head pressure differential between the nozzle surface 112A of the head unit 112 and the ink cartridge 114, and ink can therefore be supplied automatically from the ink supply system to the negative pressure maintaining unit 126. Furthermore, after replenishment of ink, the negative pressure maintaining unit 126 is decoupled from the ink supply coupling section 148, and with the negative pressure maintaining unit 126 in a separated state from the ink supply coupling section 148, the negative pressure generated inside the head is maintained at a suitable level by means of the sub tank 190 which is sealed inside the negative pressure maintaining unit 126.

Furthermore, if air bubbles enter in via the coupling section 149 due to repeated ink supply operations during the execution of a print job, then these air bubbles collect in the bubble collecting section 206 (see FIG. 16) situated in the top portion of the negative pressure maintaining unit 126 (see FIG. 16). If the amount of air bubbles inside the negative pressure maintaining unit 126 increases, then the amount of air bubbles inside the sub tank 190 also increases, and consequently, the amount of ink that can be accommodated in the sub tank 190 declines. If the amount of ink inside the sub tank 190 declines in this way, then the number of prints which can be made by means of one ink supply operation also becomes lower, and therefore, in order to avoid situations of this kind, a desirable mode is one in which the cap 260 (see FIG. 21) is pressed against the nozzle surface 112A and the bubble expulsion chamber 180 during the ink supply operation, the second valve 284 (see FIG. 21) is opened while the first valve 282 is closed, and the suction pump 288 is then operated in order to expel the air bubbles inside the negative pressure maintaining unit 126, via the bubble expulsion port 184.

As described above, according to a mode in which the device which suctions bubbles via the bubble expulsion port 184 of the negative pressure maintaining unit 126 and the device which suctions ink via the nozzles are used in common by the suction pump 288, a switching device (first valve 282 and second valve 284) being provided to switch between two types of suction mode (suction route), then by operating and switching the suction mode in a state where the head unit 112 and the sub cartridge 140 are coupled together, it is possible to ensure expulsion of air bubbles, removal of ink of increased viscosity in the head meniscus sections, reliable supply of ink into the sub tank 190, and generation and maintenance of negative pressure due to the hydraulic head pressure differential between the nozzle surface of the head and the ink cartridge 114.

Furthermore, since there is a function for removing the air bubbles which collect in the upper side of the sub tank 190, based on a gas/liquid separating function inside the sub tank 190, then there is a reduced possibility of ejection abnormalities caused by infiltration of air bubbles into the head, and it is possible to expel the air bubbles which have been separated from the liquid, alone. Therefore, improved efficiency in the usage of the ink can be expected.

Furthermore, in this inkjet recording apparatus 110 according to the present embodiment, if the ink viscosity has increased inside the nozzles due to drying of the meniscus, and if it has therefore become impossible to carry out preliminary ejection (purge), then it is possible to suction the ink of increased viscosity from the nozzles by placing the cap 260 in tight contact with the nozzle surface 112A, opening the first valve 282 (and closing the second valve 284), and operating the suction pump 288. By suctioning and removing the degraded ink inside the nozzles in this way, the print head can be returned to a state in which it can perform ejection.

Although omitted from the drawings, by dividing the nozzles of the print head into a plurality of blocks and designing the cap 260 with a structure that allows suction to be carried out with respect to each individual nozzle block, it is possible to reduce the amount of ink consumed wastefully by the suctioning operation.

Print Sequence when Remaining Ink Runs Out

Figure 24:
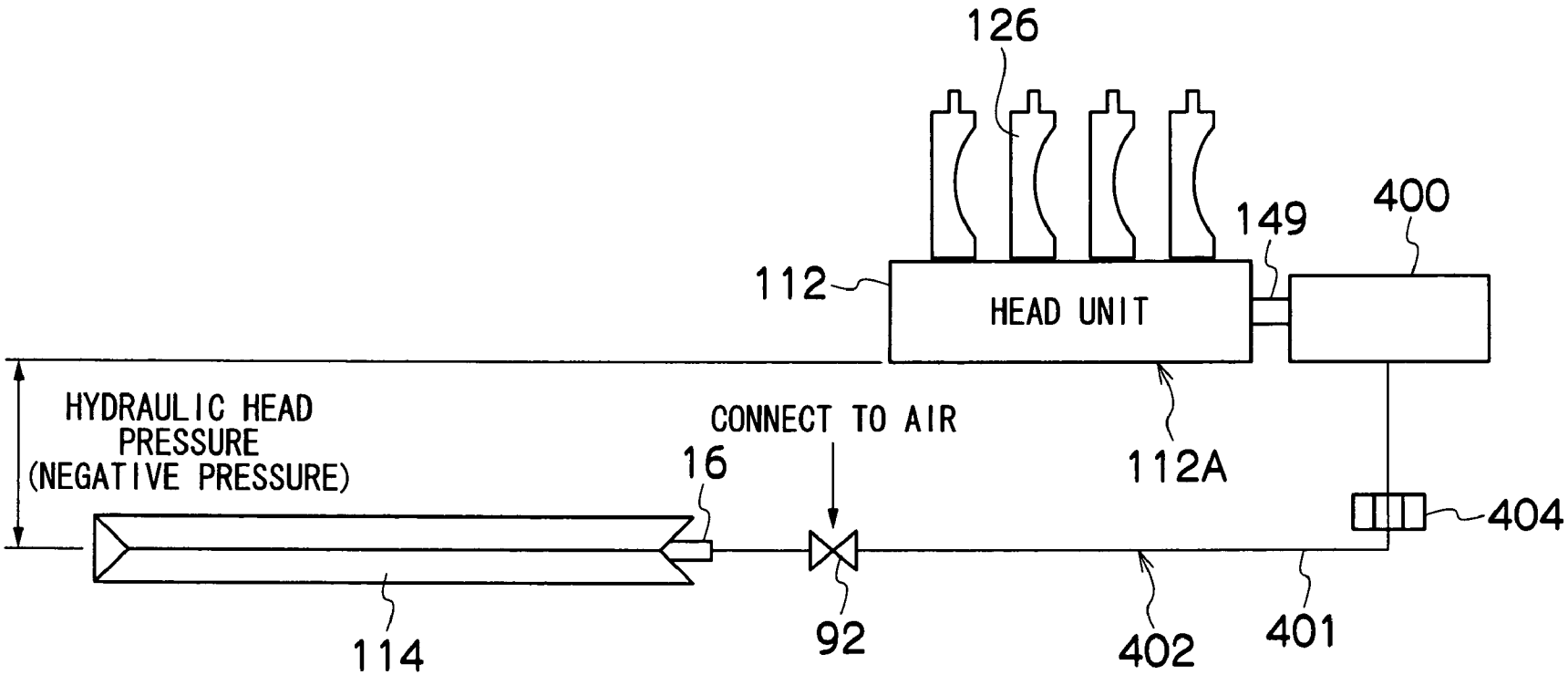
FIG. 24 is a schematic drawing showing the composition of an ink supply system.

FIG. 24 is a schematic drawing of the composition of an ink supply system. In FIG. 24, the portion corresponding to the ink supply coupling sections 148 of the sub cartridge 140 illustrated in FIG. 13 is denoted as a "pit stop coupling section 400". As shown in FIG. 24, the pit stop coupling section 400 is connected to the ink cartridge 114 via an air connection valve 92 and an ink supply tube 402 which forms an ink supply channel 401. The ink cartridge 114 is disposed in a lower position than the nozzle surface 112A of the head unit 112, and a remaining amount of ink determination device 404 for determining the remaining amount of ink inside the ink supply channel 401 (which corresponds to a "remaining amount of ink in supply channel determination device" and is constituted by an optical sensor formed by a light-emitting element and a photoreceptor element, for example) is provided in the ink supply channel 401 constituted by the ink supply tube 402.

The ink supply channel 401 from the ink cartridge 114 to the pit stop coupling section 400 and the remaining amount of ink determination device 404 provided in this ink supply channel 401 are disposed in the same horizontal plane (in a horizontal plane at the same height). By adopting an arrangement of this kind, even in cases where the ink supply channel 401 is open to the external air via the air connection valve 92, a uniform negative pressure can be maintained until the remaining amount of ink determination device 404 determines an "out of ink" state.

FIG. 25 is a flowchart of a sequence when the remaining ink runs out.

As shown in FIG. 25, when a print job is started (step S50), the remaining amount of ink in the ink cartridge 114 is determined, and on the basis of these determination results, it is judged whether or not the remaining amount of ink in the cartridge is equal to or greater than a specified amount for displaying an ink replacement alarm (step S52).

The remaining amount of ink inside the ink cartridge 114 is determined on the basis of the signals obtained from the photoreceptor elements 24 and 26 shown in FIG. 2. The evaluation of the remaining amount of ink uses a two-stage judgment, based on a specified amount ("specified amount for alarm display") which forms a reference for judging whether or not to issue an ink replacement display prompting replacement of the ink cartridge 114, and a specified amount ("specified amount for replacement") indicating the final end level at which replacement of the ink cartridge 114 is necessary (ink can no longer be extracted).

For example, the specified amount for replacement is set to a remaining amount of ink of 0.1 ml (milliliters), and the specified amount for alarm display is set to a remaining amount of ink of 0.3 ml (milliliters), which arises before the specified amount for replacement.

At step S52, if it is judged that the remaining amount of ink in the ink cartridge 114 is equal to or greater than the specified amount for alarm display (YES verdict), then printing is continued (step S54), and the procedure returns to step S52.

On the other hand, at step S52, if it is judged that the remaining amount of ink in the ink cartridge 114 is less than the specified amount for alarm display (NO verdict), then the procedure advances to step S56 and a display (warning display) prompting replacement of the ink cartridge is created.

Thereupon, it is judged whether or not replacement of an ink cartridge 114 has been carried out by the user (step S58), and if replacement of the ink cartridge has been carried out, then the ink replacement display is turned off and printing is continued (step S54).

At step S58, if the ink cartridge has not been replaced by the user and the verdict is NO, then the procedure advances to step S60. At step S60, it is judged whether or not the remaining amount of ink inside the ink cartridge 114 is equal to or greater than the specified amount for replacement. If ink of an amount equal to or greater than the specified amount for replacement is remaining in the ink cartridge 114, then printing is continued in this state (step S54).

Printing is continued without the ink cartridge being replaced, and at step S60, if it is judged that the remaining amount of ink is less than the specified amount for replacement (NO verdict), then the air connection valve 92 which is provided in the vicinity of the ink expulsion port (ink supply port 16) of the ink cartridge 114, on the downstream side, is opened (step S62), and printing is continued by using the ink inside the sub tank 190 from the portion of the ink supply channel where the air connection valve 92 is positioned (see FIG. 24).

During this, the ink cartridge replacement display continues to be presented to the user. Furthermore, while printing is continued with the air connection valve 92 in an opened state, the remaining amount of ink inside the ink supply channel is determined by means of the remaining amount of ink determination device 404 provided in the ink supply channel, and it is judged whether or not there is an amount of ink sufficient to continue printing left inside the ink supply channel (step S64 in FIG. 25).

If it is judged at step S64 that "ink is present" with respect to the remaining amount of ink inside the ink supply channel, then the procedure advances to step S66 and it is judged whether or not the ink cartridge 114 has been replaced by the user. If the ink cartridge has not been replaced and the verdict is NO, then printing is continued and the procedure returns to step S64.

If the remaining amount of ink inside the ink supply channel is judged to be "ink present" at step S64 (YES verdict) as described above, then printing is continued, but if the remaining amount of ink inside the ink supply channel is judged to be "ink absent" at step S64, then printing is halted (step S68).

Furthermore, if the ink cartridge 114 has been replaced by the user and the verdict is YES at step S66, then the ink replacement display is turned off, but printing is continued subsequently by using the ink inside the sub tank, from the ink supply channel at the position of the air connection valve 92. Thereupon, if the negative pressure value of the ink inside the ink supply channel and the interior of the sub tank has become equal to or greater than a specified value, then the air connection valve 92 is closed, and the initial filling operation described above is carried out (step S70), thereby filling ink into the ink supply channel.

The determination of the remaining amount of ink inside the ink supply channel is not limited to a mode where a sensor is provided in the ink supply tube, as shown in FIG. 24, and it is also possible to determine the remaining amount of ink by calculating the amount of ink consumed through counting the size of the ejection droplets and the number of ejected droplets, and to then estimate the remaining amount of ink inside the flow channel on this basis.

By implementing the control procedure illustrated in FIG. 25, it is possible to continue printing by using the ink remaining inside the ink supply channel, even if the ink inside the ink cartridge has run out.

Furthermore, the inkjet recording apparatus 110 according to the present embodiment also has the following merits.

More specifically, according to the inkjet recording apparatus 110 of the present embodiment, the conveyance path along which recording paper 116 is conveyed from the paper supply unit 118 (paper supply cassette) to the head unit 112 adopts a structure in which the front surface and the rear surface of the recording paper 116 are inverted, and ink cartridges 114 are provided between the paper supply unit 118 and the head unit 112 which is located above same. According to this structure, the operation of installing and removing the paper supply cassette and the ink cartridges 114 is carried out via the front surface side of the apparatus, and therefore it is possible to reduce the dimensions of the apparatus in the depth direction, as well as ensuring free space on the upper surface of the apparatus.

Moreover, by forming the ink cartridges 114 with a flat shape, it is possible to reduce the dimension of the ink cartridges 114 in the height direction, and hence to reduce the overall height of the apparatus.

Since the apparatus comprises the sub cartridge 140 into which the ink cartridges 114 are installed and the ink supply system is accommodated inside the sub cartridge 140, and furthermore, since the sub cartridge 140 is composed in such a manner that it can be installed in and removed from the main body of the apparatus via the front surface side of the main body of the apparatus, then it is possible to arrange the ink supply system in a compact fashion, and the structure inside the apparatus is simplified.

Since the waste ink tank 162 which collects waste ink produced during borderless printing or restoration processing is provided inside the sub cartridge 140, and since this waste ink tank 162 can be installed in and removed from the sub cartridge 140, then improved maintenance characteristics can be expected.

Moreover, since the sub cartridge 140 is provided with the guide member 154 which functions as the conveyance guide section 150 forming a guide for the recording paper 116 in the print region directly below the head unit 112, as well as functioning as the ink receiving section 152 which receives ink that has strayed beyond the width of the recording paper 116 during borderless printing, and since the guide member 154 is composed in such a manner that it can be attached to and detached from the sub cartridge, then problems in conveyance of the recording paper 116 in the print region are prevented and maintenance can be carried out readily in respect of soiling of the conveyance guide section 150 occurring during borderless printing.

During the supply of ink, the print heads 112C, 112M, 112Y, 112K of the respective colors are connected to the ink supply system provided inside the sub cartridge 140 and ink is supplied to the negative pressure maintaining unit 126 and the head unit 112 from the ink supply system due to the liquid head pressure differential between the nozzle surface of the head and the ink cartridge 114. Furthermore, since negative pressure maintaining unit 126 is connected onto the head unit 112 in order to control the negative pressure inside the head during printing, and since the internal pressure (negative pressure) of the print heads is controlled by the negative pressure maintaining unit 126 with reference to the liquid head pressure differential between the nozzle surface of the head and the ink cartridge, then there is no need to provide a pressure generating device, such as a pump, in order to create and maintain a negative pressure inside the head.

This negative pressure maintaining unit 126 in the inkjet recording apparatus 110 described above comprises a system that creates and maintains a negative pressure by means of an elastically deformable member (a plastic film 192 and a leaf spring 194); therefore in comparison with a conventional system based on a suction member which creates and maintains a negative pressure inside the head by means of capillary action, the amount of ink left inside the ink cartridges 114 is smaller, and hence more efficient use of the ink can be expected.

Moreover, the present inkjet recording apparatus 110 adopts a composition which comprises a gas/liquid separating function inside the sub tank 190, and therefore, unlike a conventional composition in which an ink absorbing member having a gas/liquid separating function is provided on the side which separates from the head, there is no occurrence of residual ink left in an ink absorbing member, and no ink wastage arises.

As described above, in a conventional system in which an ink absorbing member that uses capillary action is provided in the ink supply unit, a problem arises in that as the viscosity of the ink rises, the pressure loss increases and the responsiveness of the ink supply deteriorates. In particular, in low temperature conditions, the ink viscosity increases, and furthermore, if the print duty is even greater, then problems relating to the response of ink supply arise.

Since the apparatus according to the present embodiment does not comprise an ink supply member based on capillary action, provided in the ink supply unit, then the responsiveness of the ink supply is increased and the ink supply time is shortened in comparison with the related art method described above. Furthermore, due to the good responsiveness of the ink supply, a uniform negative pressure can be maintained readily inside the print head, and therefore, beneficial effects are obtained in preventing variations in the density of the printed matter, and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ink cartridge comprising:

a cartridge container having a flat box shape;

an ink bag that is made of a plastic material or an elastic body, accommodates ink, is disposed in the cartridge container, and has an ink supply port via which the ink is extracted from the ink bag, wherein:

the cartridge container has an air connection port by which an interior of the cartridge container in which the ink bag disposed is able to connect to an atmospheric air;

the ink bag has a flat shape matching the flat box shape of the cartridge container;

the ink bag is provided with a negative pressure generating device which applies impelling force to the ink bag in a direction of expanding a volume of the ink bag to generate a negative pressure inside the ink bag;

the impelling force applied to generate the negative pressure inside the ink bag by the negative pressure generating device, becomes less in a continuous or a stepwise fashion, as a distance from the ink supply port of the ink bag increases;

the negative pressure generating device comprises a first spring member and a second spring member which are provided on an outer circumferential face of the ink bag at a plurality of positions at different distances from the ink supply port, the first spring member being relatively nearer to the ink supply port and the second spring member being relatively farther from the ink supply port; and the impelling force of the first spring is greater than the impelling force of the second spring member.

2. An ink cartridge comprising:

a cartridge container having a flat box shape;

an ink bag that is made of a plastic material or an elastic body, accommodates ink, is disposed in the cartridge container, and has an ink supply port via which the ink is extracted from the ink bag, wherein:

the cartridge container has an air connection port by which an interior of the cartridge container in which the ink bag disposed is able to connect to an atmospheric air;

the ink bag has a flat shape matching the flat box shape of the cartridge container;

the ink bag is provided with a negative pressure generating device which applies impelling force to the ink bag in a direction of expanding a volume of the ink bag to generate a negative pressure inside the ink bag; and the impelling force applied to generate the negative pressure inside the ink bag by the negative pressure generating device, becomes less in a continuous or a stepwise fashion, as a distance from the ink supply port of the ink bag increases; and the ink bag is constituted by an elastic body, elastic force in a portion of the elastic body which is relatively nearer the ink supply port being greater than elastic force in a portion of the elastic body which is relatively farther from the ink supply port.

3. The ink cartridge as defined in claim 2, wherein the ink bag is constituted by the elastic body of which a thickness of the portion which is relatively nearer the ink supply port is greater than a thickness of the portion which is relatively farther from the ink supply port.

4. An ink cartridge comprising:

a cartridge container having a flat box shape;

an ink bag that is made of a plastic material or an elastic body, accommodates ink, is disposed in the cartridge container, and has an ink supply port via which the ink is extracted from the ink bag, wherein:

the cartridge container has an air connection port by which an interior of the cartridge container in which the ink bag disposed is able to connect to an atmospheric air;

the ink bag has a flat shape matching the flat box shape of the cartridge container;

the ink bag is provided with a negative pressure generating device which applies impelling force to the ink bag in a direction of expanding a volume of the ink bag to generate a negative pressure inside the ink bag;

the impelling force applied to generate the negative pressure inside the ink bag by the negative pressure generating device, becomes less in a continuous or a stepwise fashion, as a distance from the ink supply port of the ink bag increases;

the ink bag has light transmitting regions through which light can pass in a thickness direction of the ink bag, and which are provided in a plurality of positions at different distances from the ink supply port; and the cartridge container has a plurality of light passing sections which enable the light to pass through the light transmitting regions.

5. The ink cartridge as defined in claim 4, wherein the light passing sections form apertures of the air connection ports.

6. An inkjet recording apparatus comprising:

an ink cartridge which includes: a cartridge container having a flat box shape; an ink bag that is made of a plastic material or an elastic body, accommodates ink, is disposed in the cartridge container, and has an ink supply port via which the ink is extracted from the ink bag, wherein: the cartridge container has an air connection port by which an interior of the cartridge container in which the ink bag disposed is able to connect to an atmospheric air; the ink bag has a flat shape matching the flat box shape of the cartridge container; the ink bag is provided with a negative pressure generating device which applies impelling force to the ink bag in a direction of expanding a volume of the ink bag to generate a negative pressure inside the ink bag; and the impelling force applied to generate the negative pressure inside the ink bag by the negative pressure generating device, becomes less in a continuous or a stepwise fashion, as a distance from the ink supply port of the ink bag increases;

a print head that has nozzles from which ink is ejected;

a sub tank which is disposed above the print head, stores the ink supplied from the ink cartridge, and connects to the print head to supply the ink to the print head;

a scanning device which moves the print head in a direction perpendicular to a direction of conveyance of a recording medium;

a remaining ink amount in cartridge determination device which determines a remaining amount of the ink in the ink bag of the ink cartridge;

an ink supply channel via which the ink is supplied to the print head from the ink cartridge;

an air releasing valve provided in a vicinity of the ink supply port of the ink bag, on a downstream side of the ink supply port;

a remaining ink amount in supply channel determination device which determines a remaining amount of the ink in the ink supply channel; and a control device which implements control in such a manner that, when the control device judges that the remaining amount of the ink in the ink bag determined by the remaining ink amount in cartridge determination device is less than a prescribed value, the air releasing valve is opened to continue printing and the control device further implements control in such a manner that:

the printing is continued when the control device judges that the remaining amount of the ink in the ink supply channel determined by the remaining ink amount in supply channel determination device is sufficient to continue the printing; and the printing is halted when the control device judges that the remaining amount of the ink in the ink supply channel determined by the remaining ink amount in supply channel determination device is not sufficient to continue the printing.

7. The inkjet recording apparatus as defined in claim 6, wherein:

a surface of one portion of the sub tank is constituted by an elastic deformation member formed by a combination of a plastic film and a leaf spring; and the elastic deformation member is displaced in such a manner that an interior of the sub tank is maintained at a negative pressure.

8. The inkjet recording apparatus as defined in claim 6, wherein:

an ink supply coupling section of the ink supply channel is provided in at least one end section of a region in which the print head is moved by means of the scanning device, and connects to the ink supply port of the ink cartridge;

a coupling section which is couplable to and decouplable from the ink supply coupling section is provided on a side of the sub tank above the print head; and when the ink is supplied to the sub tank, the coupling section is coupled to the ink supply coupling section, whereas when printing is carried out by means of the print head, the coupling section is decoupled from the ink supply coupling section.

9. The inkjet recording apparatus as defined in claim 6, wherein the remaining ink amount in the supply channel determination device includes a sensor arranged in the ink supply channel.

10. The inkjet recording apparatus as defined in claim 6, wherein the remaining ink amount in the supply channel determination device estimates the remaining amount of the ink in the ink supply channel by calculating an amount of the ink consumed after the air releasing valve is opened.

* * * * *